US007304631B2

(12) United States Patent
Morita et al.

(10) Patent No.: US 7,304,631 B2
(45) Date of Patent: Dec. 4, 2007

(54) DISPLAY DRIVER CIRCUIT AND DISPLAY DEVICE

(75) Inventors: Akira Morita, Suwa (JP); Yuichi Toriumi, Chino (JP)

(73) Assignee: Seiko Epson Corporation, Tokyo (JP)

( * ) Notice: Subject to any disclaimer, the term of this patent is extended or adjusted under 35 U.S.C. 154(b) by 339 days.

(21) Appl. No.: 10/644,795

(22) Filed: Aug. 21, 2003

(65) Prior Publication Data

US 2004/0070589 A1 Apr. 15, 2004

(30) Foreign Application Priority Data

Aug. 27, 2002 (JP) ..... 2002-247299

(51) Int. Cl.
*G09G 3/36* (2006.01)
*G09G 5/10* (2006.01)

(52) U.S. Cl. ..... 345/100; 345/89; 345/690

(58) Field of Classification Search ..... 345/87–92, 345/94, 98–100, 103, 204–206, 208–211, 345/690; 377/64, 67, 69, 70, 73, 75, 76, 377/80, 81; 365/78
See application file for complete search history.

(56) References Cited

U.S. PATENT DOCUMENTS 5,103,218 A * 4/1992 Takeda ..... 345/100
5,192,945 A * 3/1993 Kusada ..... 345/88
5,602,561 A * 2/1997 Kawaguchi et al. ..... 345/99
5,726,677 A * 3/1998 Imamura ..... 345/99
6,130,657 A * 10/2000 Kurokawa et al. ..... 345/100
6,222,518 B1 * 4/2001 Ikeda et al. ..... 345/98

* cited by examiner

*Primary Examiner*—Jeff Piziali
(74) *Attorney, Agent, or Firm*—Oliff & Berridge, PLC

(57) ABSTRACT

A display driver circuit includes first to Mth SR blocks which are disposed in a region on the right side of a data input control circuit and hold first to Mth gray-scale data, and (M+1)th to (M+N)th SR blocks which are disposed in a region on the left side of the data input control circuit and hold (M+1)th to (M+N)th gray-scale data. The first to (M+N)th SR blocks hold the first to (M+N)th gray-scale data for which mask control is performed based on a data enable signal shifted by each SR block. The first to Mth gray-scale data is masked in order from first to Mth data mask circuit. The (M+1)th to (M+N)th gray-scale data are unmasked in order from (M+1)th to (M+N)th data mask circuit.

10 Claims, 28 Drawing Sheets

RELATED ART

RELATED ART

RELATED ART

RELATED ART

DISPLAY DRIVER CIRCUIT AND DISPLAY DEVICE

Japanese Patent Application No. 2002-247299 filed on Aug. 27, 2002, is hereby incorporated by reference in its entirety.

BACKGROUND OF THE INVENTION

The present invention relates to a display driver circuit and a display device.

A liquid crystal panel (display panel in a broad sense) performs color representation by using gray-scale (gradation) display, for example. Therefore, a signal driver (display driver circuit in a broad sense) which drives signal electrodes of the liquid crystal panel includes signal electrode driver circuits corresponding to the signal electrodes. Each signal electrode driver circuit outputs a drive voltage corresponding to gray-scale data held in the corresponding latch.

BRIEF SUMMARY OF THE INVENTION

According to the first aspect of the present invention, there is provided a display driver circuit which drives signal electrodes of a display device based on gray-scale data, comprising:

first to (M+N)th (M and N are positive integers) shift register blocks;

a data input control circuit which controls input of the gray-scale data supplied to the first to (M+N)th shift register blocks;

first to (M+N)th data mask circuits which generate first to (M+N)th gray-scale data by performing mask control for the gray-scale data supplied to the first to (M+N)th shift register blocks and output the first to (M+N)th gray-scale data; and a signal electrode driver circuit which drives the signal electrodes by using drive voltages corresponding to the first to (M+N)th gray-scale data, the first to (M+N)th gray-scale data being held in the first to (M+N)th shift register blocks, wherein the first to Mth shift register blocks are disposed in a region on a first direction side of the data input control circuit, shift a given data enable signal input to the first shift register block and output the shifted data enable signal to a shift register block adjacent in a second direction opposite to the first direction, and hold the first to Mth gray-scale data based on the shifted data enable signal, wherein the (M+1)th to (M+N)th shift register blocks are disposed in a region on the second direction side of the data input control circuit, shift a data enable signal input to the (M+1)th shift register block from the Mth shift register block and output the shifted data enable signal to a shift register block adjacent in the second direction, and hold the (M+1)th to (M+N)th gray-scale data based on the shifted data enable signal, wherein the first to Mth data mask circuits are connected in the second direction in order from the first to Mth data mask circuit and mask the first to Mth gray-scale data in order from the first to Mth data mask circuit, and wherein the (M+1)th to (M+N)th data mask circuits are connected in the second direction in order from the (M+1)th to (M+N)th data mask circuit and unmask the (M+1)th to (M+N)th gray-scale data in order from the (M+1)th to (M+N)th data mask circuit.

According to the second aspect of the present invention, there is provided a display driver circuit which drives signal electrodes of a display device based on gray-scale data, comprising:

first to (M+N)th (M and N are positive integers) shift register blocks;

a clock input control circuit which controls input of a clock signal which is supplied to each of the first to (M+N)th shift register blocks and determines shift timing;

first to (M+N)th clock mask circuits which generate first to (M+N)th clock signals by performing mask control for the clock signal supplied to the first to (M+N)th shift register blocks and output the first to (M+N)th clock signals; and a signal electrode driver circuit which drives the signal electrodes by using drive voltages corresponding to first to (M+N)th gray-scale data, the first to (M+N)th gray-scale data being held in the first to (M+N)th shift register blocks, wherein the first to Mth shift register blocks are disposed in a region on a first direction side of the clock input control circuit, shift a given data enable signal input to the first shift register block based on the first to Mth clock signals and output the shifted data enable signal to a shift register block adjacent in a second direction opposite to the first direction, and hold the first to Mth gray-scale data based on the shifted data enable signal, wherein the (M+1)th to (M+N)th shift register blocks are disposed in a region on the second direction side of the clock input control circuit, shift a data enable signal input to the (M+1)th shift register block from the Mth shift register block based on the (M+1)th to (M+N)th clock signals and output the shifted data enable signal to a shift register block adjacent in the second direction, and hold the (M+1)th to (M+N)th gray-scale data based on the shifted data enable signal, wherein the first to Mth clock mask circuits are connected in the second direction in order from the first to Mth clock mask circuit and mask the first to Mth clock signals in order from the first to Mth clock mask circuit, and wherein the (M+1)th to (M+N)th clock mask circuits are connected in the second direction in order from the (M+1)th to (M+N)th clock mask circuit and unmask the (M+1)th to (M+N)th clock signals in order from the (M+1)th to (M+N) th clock mask circuit.

According to the third aspect of the present invention, there is provided a display driver circuit which drives signal electrodes of a display device based on gray-scale data, comprising:

first to Mth (M is a positive integer) shift register blocks;

a data input control circuit which controls input of the gray-scale data supplied to the first to Mth shift register blocks;

first to Mth data mask circuits which generate first to Mth gray-scale data by performing mask control for the gray-scale data supplied to the first to Mth shift register blocks and output the first to Mth gray-scale data, first to Mth gray-scale data being held in the first to Mth shift register blocks; and a signal electrode driver circuit which drives the signal electrodes by using drive voltages corresponding to the first to Mth gray-scale data, wherein the first to Mth shift register blocks are disposed in a region on a first direction side of the data input control circuit, shift a given data enable signal input to the first shift register block and output the shifted data enable signal to a shift register block adjacent in a second direction opposite to the first direction, and hold the first to Mth gray-scale data, for which mask control is performed by the first to Mth data mask circuits, based on the shifted data enable signal, and wherein the first to Mth data mask circuits are connected in the second direction in order from the first to Mth data mask circuit and mask the first to Mth gray-scale data in order from the first to Mth data mask circuit.

According to the fourth aspect of the present invention, there is provided a display driver circuit which drives signal electrodes of a display device based on gray-scale data, comprising:

first to Nth (N is a positive integer) shift register blocks;

a data input control circuit which controls input of the gray-scale data supplied to the first to Nth shift register blocks;

first to Nth data mask circuits which generate first to Nth gray-scale data by performing mask control for the gray-scale data supplied to the first to Nth shift register blocks and output the first to Nth gray-scale data, the first to Nth gray-scale data being held in the first to Nth shift register blocks; and a signal electrode driver circuit which drives the signal electrodes by using drive voltages corresponding to the first to Nth gray-scale data, wherein the first to Nth shift register blocks are disposed in a region on a second direction side of the data input control circuit, shift a given data enable signal input to the first shift register block and output the shifted data enable signal to a shift register block adjacent in the second direction, and hold the first to Nth gray-scale data, for which mask control is performed by the first to Nth data mask circuits, based on the shifted data enable signal, and wherein the first to Nth data mask circuits are connected in the second direction in order from the first to Nth data mask circuit and unmask the first to Nth gray-scale data in order from the first to Nth data mask circuit.

According to the fifth aspect of the present invention, there is provided a display driver circuit which drives signal electrodes of a display device based on gray-scale data, comprising:

first to Mth (M is a positive integer) shift register blocks;

a clock input control circuit which controls input of a clock signal which is supplied to each of the first to Mth shift register blocks and determines shift timing;

first to Mth clock mask circuits which generate first to Mth clock signals by performing mask control for the clock signal supplied to the first to Mth shift register blocks and output the first to Mth clock signals; and a signal electrode driver circuit which drives the signal electrodes by using drive voltages corresponding to first to Mth gray-scale data, wherein the first to Mth shift register blocks are disposed in a region on a first direction side of the clock input control circuit, shift a given data enable signal input to the first shift register block based on the first to Mth clock signals and output the shifted data enable signal to a shift register block adjacent in a second direction opposite to the first direction, and hold the first to Mth gray-scale data based on the shifted data enable signal, and wherein the first to Mth clock mask circuits are connected in the second direction in order from the first to Mth clock mask circuit and mask the first to Mth clock signals in order from the first to Mth clock mask circuit.

According to the sixth aspect of the present invention, there is provided a display driver circuit which drives signal electrodes of a display device based on gray-scale data, comprising:

first to Nth (N is a positive integer) shift register blocks;

a clock input control circuit which controls input of a clock signal which is supplied to each of the first to Nth shift register blocks and determines shift timing;

first to Nth clock mask circuits which generate first to Nth clock signals by performing mask control for the clock signal supplied to the first to Nth shift register blocks and output the first to Nth clock signals; and a signal electrode driver circuit which drives the signal electrodes by using drive voltages corresponding to first to Nth gray-scale data, wherein the first to Nth shift register blocks are disposed in a region on a second direction side of the clock input control circuit, shift a given data enable signal input to the first shift register block based on the first to Nth clock signals and output the shifted data enable signal to a shift register block adjacent in the second direction, and hold the first to Nth gray-scale data based on the shifted data enable signal, and wherein the first to Nth clock mask circuits are connected in the second direction in order from the first to Nth clock mask circuit and unmask the first to Nth clock signals in order from the first to Nth clock mask circuit.

DETAILED DESCRIPTION OF THE EMBODIMENT

Embodiments of the present invention are described below. Note that the embodiments described hereunder do not in any way limit the scope of the invention defined by the claims laid out herein. Note also that all of the elements described below should not be taken as essential requirement to the present invention.

A signal driver generally drives a large number of signal electrodes of a display panel. Therefore, in order to enable the signal driver to be efficiently mounted on the end of a display panel, circuits of the signal driver are formed so that the arrangement direction of the signal electrodes is the direction of the long side and the direction which intersects the arrangement direction of the signal electrodes is the direction of the short side. Therefore, the length of a gray-scale bus which supplies gray-scale data is increased in the direction of the long side of the signal driver, whereby the load of the gray-scale bus is increased. Therefore, power consumption accompanying driving of the gray-scale bus is increased.

According to the embodiments of the present invention, a display driver circuit and a display device capable of reducing power consumption accompanying driving of the gray-scale data can be provided.

The embodiments of the present invention are described below in detail with reference to the drawings.

1. Liquid Crystal Device

Figure 1:
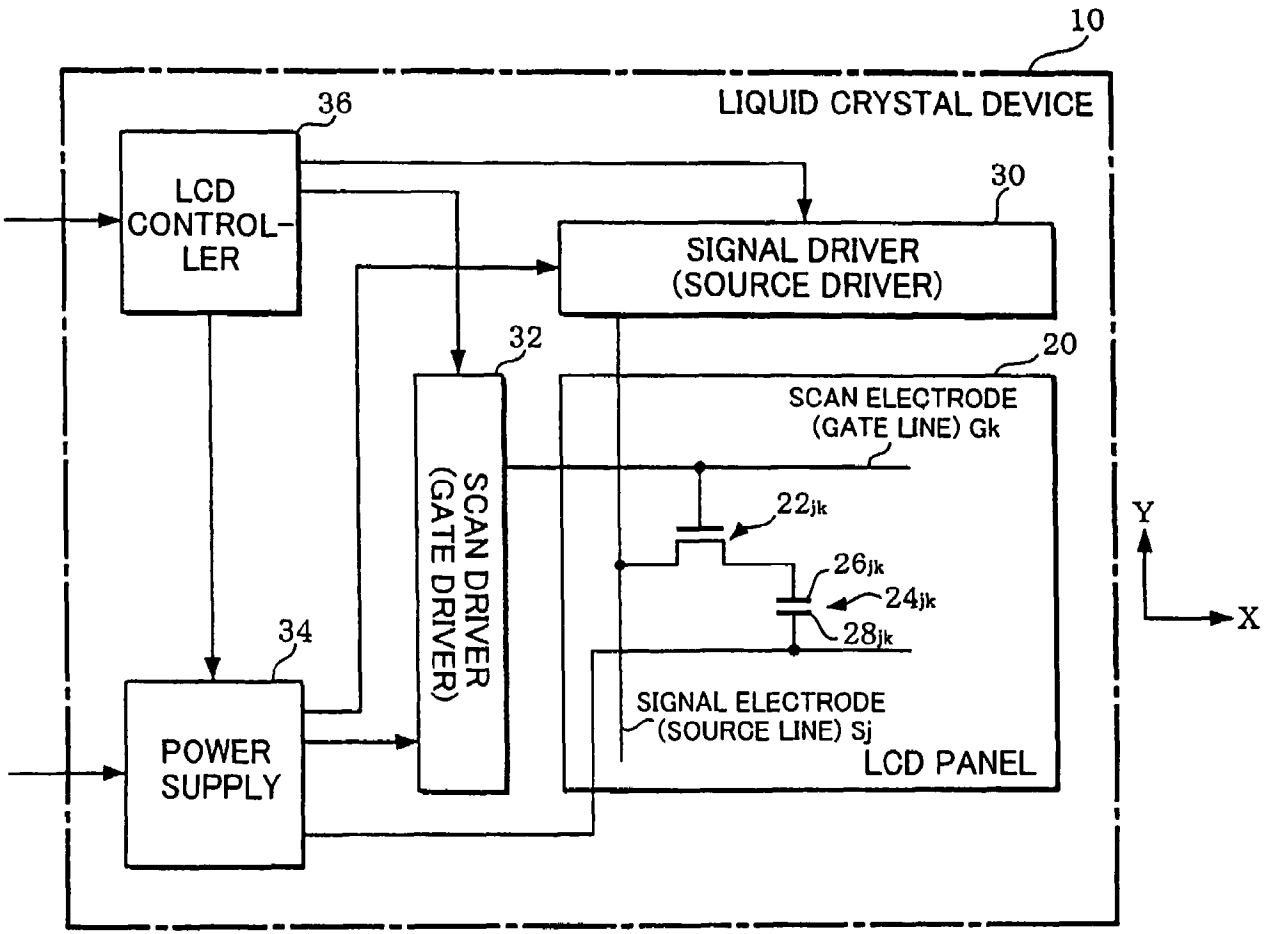
FIG. 1 RELATED ART
FIG. 1 is a block diagram showing an outline of a configuration of a liquid crystal device.

FIG. 1 shows an outline of a configuration of a liquid crystal device.

A liquid crystal device (electro-optical device or display device in a broad sense) 10 includes a LCD panel (display panel in a broad sense) 20.

The LCD panel 20 is formed on a glass substrate, for example. A plurality of first to Ath (A is an integer of two or more) scan electrodes (gate lines) $G_1$ to $G_A$, arranged in the Y direction and extending in the X direction, and a plurality of first to Bth (B is an integer of two or more) signal electrodes (source lines) $S_1$ to $S_B$, arranged in the X direction and extending in the Y direction, are disposed on the glass substrate.

A pixel (pixel region) is disposed corresponding to the intersecting point of the kth ($1 \leqq k \leqq A$, k is an integer) scan electrode Gk and the jth ($1 \leqq j \leqq B$, j is an integer) signal electrode $S_j$. The pixel includes a TFT (pixel switch element in a broad sense) $\mathbf{22}_{jk}$.

A gate electrode of the TFT $\mathbf{22}_{jk}$ is connected with the kth scan electrode $G_k$. A source electrode of the TFF $\mathbf{22}_{jk}$ is connected with the jth signal electrode $S_j$. A drain electrode of the TFT $\mathbf{22}_{jk}$ is connected with a pixel electrode $\mathbf{26}_{jk}$ of a liquid crystal capacitor (liquid crystal element in a broad sense) $\mathbf{24}_{jk}$.

The liquid crystal capacitor $\mathbf{24}_{jk}$ is formed by sealing a liquid crystal between the pixel electrode $\mathbf{26}_{jk}$ and a common electrode $\mathbf{28}_{jk}$ opposite to the pixel electrode $\mathbf{26}_{jk}$.

The transmittance of the pixel is changed corresponding to voltage applied between the pixel electrode $\mathbf{26}_{jk}$ and the common electrode $\mathbf{28}_{jk}$. A common electrode voltage Vcom is supplied to the common electrode $\mathbf{28}_{jk}$.

The liquid crystal device 10 may include a signal driver 30. A display driver circuit in the following embodiment may be applied to the signal driver 30. The signal driver 30 drives the first to Bth signal electrodes $S_1$ to $S_B$ of the LCD panel 20 based on gray-scale data.

The liquid crystal device 10 may include a scan driver 32. The scan driver 32 sequentially drives the first to Ath scan electrodes $G_1$ to $G_A$ of the LCD panel 20 in one vertical scanning period.

The liquid crystal device 10 may include a power supply circuit 34. The power supply circuit 34 generates a voltage necessary for driving the signal electrode and supplies the voltage to the signal driver 30. The power supply circuit 34 generates a voltage necessary for driving the scan electrode and supplies the voltage to the scan driver 32.

The liquid crystal device 10 may include a common electrode driver circuit (not shown). The common electrode voltage Vcom generated by the power supply circuit 34 is supplied to the common electrode driver circuit. The common electrode driver circuit outputs the common electrode voltage Vcom to the common electrode of the LCD panel 20.

The liquid crystal device 10 may include an LCD controller 36. The LCD controller 36 controls the signal driver 30, the scan driver 32, and the power supply circuit 34 according to the contents set by a host such as a central processing unit (hereinafter abbreviated as "CPU") (not shown). The LCD controller 36 provides operation mode setting and a vertical synchronization signal or a horizontal synchronization signal generated therein to the signal driver 30 and the scan driver 32, and controls polarity inversion timing of the power supply circuit 34, for example.

18-bit gray-scale data (six bits each for RGB) is sequentially input to the liquid crystal device 10 in units of pixels from the host (not shown), for example. The signal driver 30 latches the gray-scale data and drives the first to Bth signal electrodes $S_1$ to $S_B$.

The above description illustrates the case where the liquid crystal device 10 is a TFT liquid crystal device. However, the liquid crystal device 10 may be a simple matrix liquid crystal device or the like.

In FIG. 1, the scan driver 32, the power supply circuit 34, and the common electrode driver circuit or the LCD controller 36 are included in the liquid crystal device 10. However, at least one of these may be provided outside the liquid crystal device 10. The liquid crystal device 10 may include the host.

Figure 2:
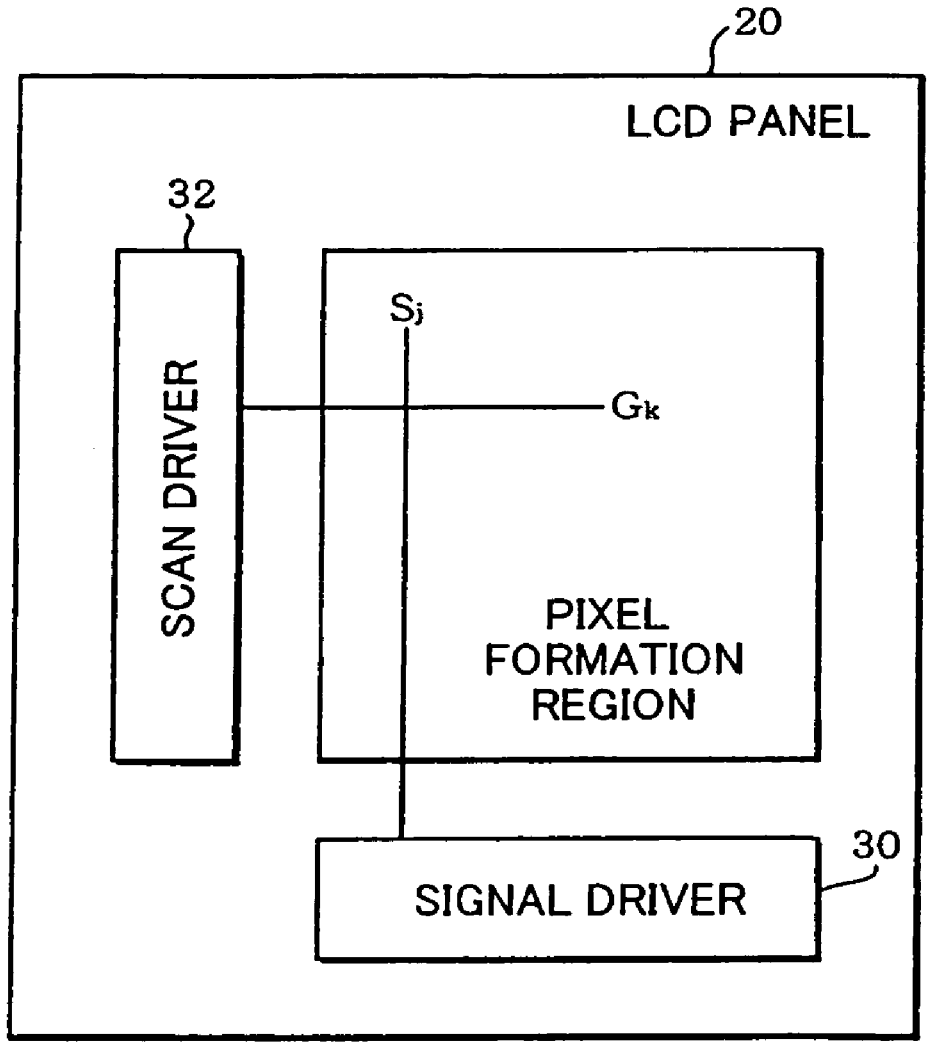
FIG. 2 is a diagram showing an outline of a configuration of a LCD panel in which a signal driver is formed on a glass substrate.

At least the signal driver 30 may be formed on the glass substrate of the LCD panel 20. Specifically, the pixel formation region of the LCD panel 20 in which the pixels are formed and the signal driver 30 may be formed on the single glass substrate. As shown in FIG. 2, the scan driver 32 may be formed on the glass substrate together with the signal driver 30.

2. Signal Driver

The signal driver 30 shown in FIGS. 1 and 2 is described below.

Figure 3:
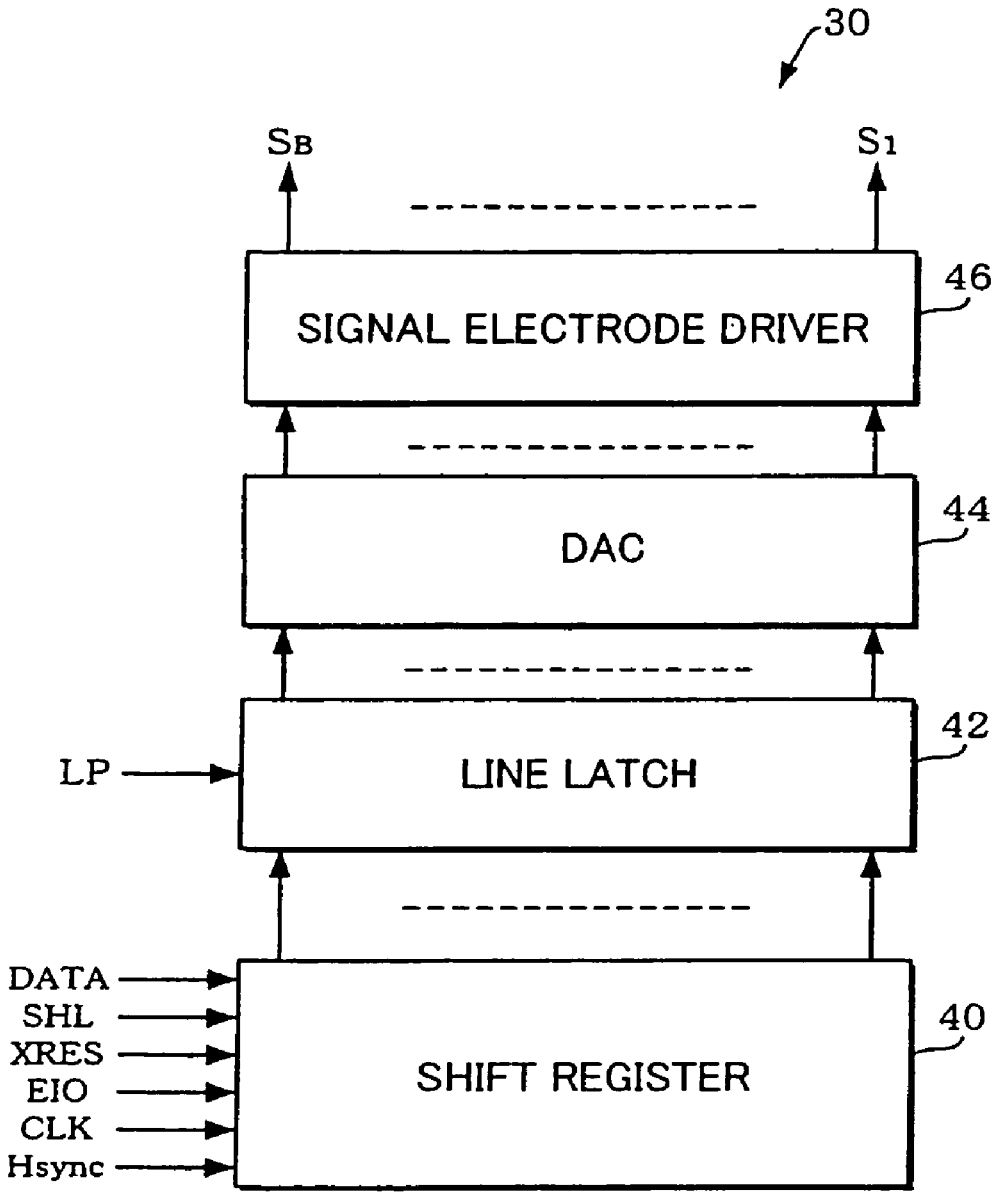
FIG. 3 is a block diagram showing an outline of a configuration of a signal driver.

FIG. 3 shows an outline of a configuration of the signal driver 30.

The signal driver 30 includes a shift register section 40, a line latch circuit 42, a DAC circuit 44, and a signal electrode driver circuit 46.

Gray-scale data DATA is input in series to the shift register section 40. In more detail, the gray-scale data DATA is fetched by the shift register section 40 based on a data enable signal EIO shifted in synchronization with a clock signal CLK. This allows the gray-scale data corresponding to one horizontal scanning period to be fetched by the shift register section 40, for example.

In FIG. 3, a shift signal SHL input to the shift register section 40 is a signal which specifies the shift direction of the shift register. Specifically, the shift direction of the shift register section 40 can be changed corresponding to the level of the shift signal SHL. Therefore, in the case where the positional relation between the signal driver 30 and the signal electrodes of the LCD panel 20 to be driven is changed depending on the mounting state of the signal driver 30, the length of the interconnects which connect the signal driver 30 with the signal electrodes can be optimized by changing the level of the shift signal SHL. A reset signal XRES input to the shift register section 40 is a signal which initializes each internal circuit. A horizontal synchronization signal Hsync is a signal which specifies horizontal scanning timing. The state of the shift register which shifts the data enable signal in a horizontal scanning period can be initialized by using the horizontal synchronization signal Hsync, for example.

The line latch circuit 42 latches the gray-scale data fetched in the shift register section 40 in response to a latch pulse signal LP.

The DAC (Digital-to-Analog Converter) circuit 44 generates a drive voltage corresponding to the gray-scale data latched by the line latch circuit 42 in units of signal electrodes. The DAC circuit 44 reads the gray-scale data latched by the line latch circuit 42 in units of signal electrodes and selects the drive voltage corresponding to the decoding results for the gray-scale data from a plurality of drive voltages.

The signal electrode driver circuit 46 includes voltage-follower-connected operational amplifier circuits corresponding to each of the first to Bth signal electrodes $S_1$ to $S_B$. The signal electrode is driven by using the operational amplifier circuit to which the drive voltage generated by the DAC circuit 44 is input.

Figure 4A:
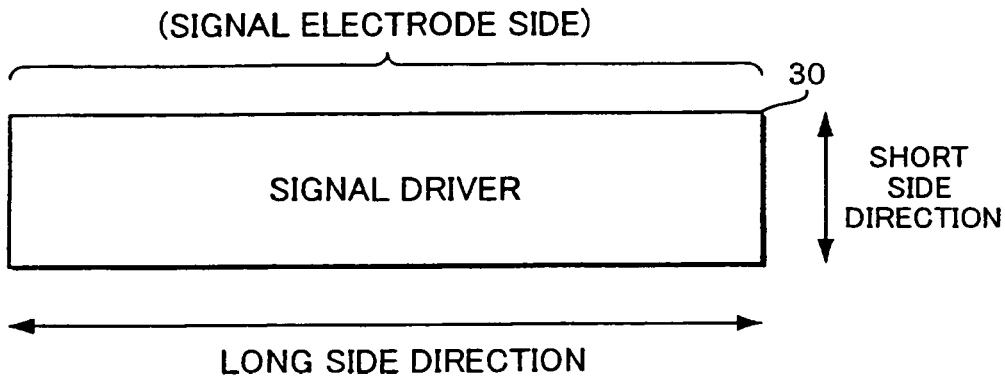
FIG. 4A is a view schematically showing the shape of a signal driver.
Figure 4B:
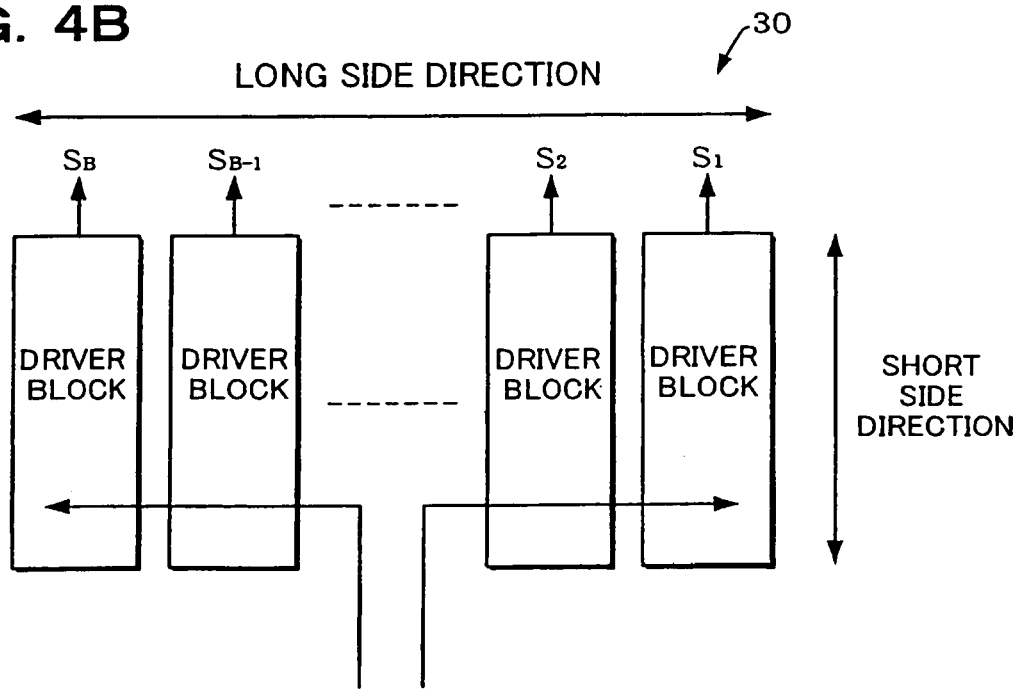
RELATED ART FIG. 4B
FIG. 4B is a view schematically showing an interconnect of a gray-scale bus.

The signal driver 30 drives a large number of signal electrodes. Therefore, the signal driver 30 is generally longer in the arrangement direction of the signal electrodes and is shorter in the direction which intersects the arrangement direction of the signal electrodes, as shown in FIG. 4A. In the signal driver 30, the length of the gray-scale bus for supplying the gray-scale data is inevitably increased in the direction of the long side of the signal driver 30. For example, in order to reduce the difference in the length of the interconnect connected to each signal electrode or to provide a control circuit necessary for various types of control at the center, the gray-scale bus is provided toward each signal electrode from near the center of the signal driver 30, as shown in FIG. 4B. However, the length of the gray-scale bus tends to be increased in the direction of the long side of the signal driver as the number of signal electrodes is increased.

Since a large amount of power is consumed for driving such a heavily loaded gray-scale bus, a problem occurs in the case where such a signal driver is incorporated in portable equipment or the like. Moreover, since there has been a tendency in which the size of the display panel is increased, power consumption accompanying driving of the gray-scale bus cannot be reduced to a large extent even if the pad pitch or the interconnect pitch is decreased by using a high definition process or the like.

To deal with this problem, a display driver circuit applied to the signal driver 30 is capable of reducing unnecessary power consumption by driving only a necessary area of the gray-scale bus when supplying the gray-scale data which is input in series to the gray-scale bus.

Figure 5:
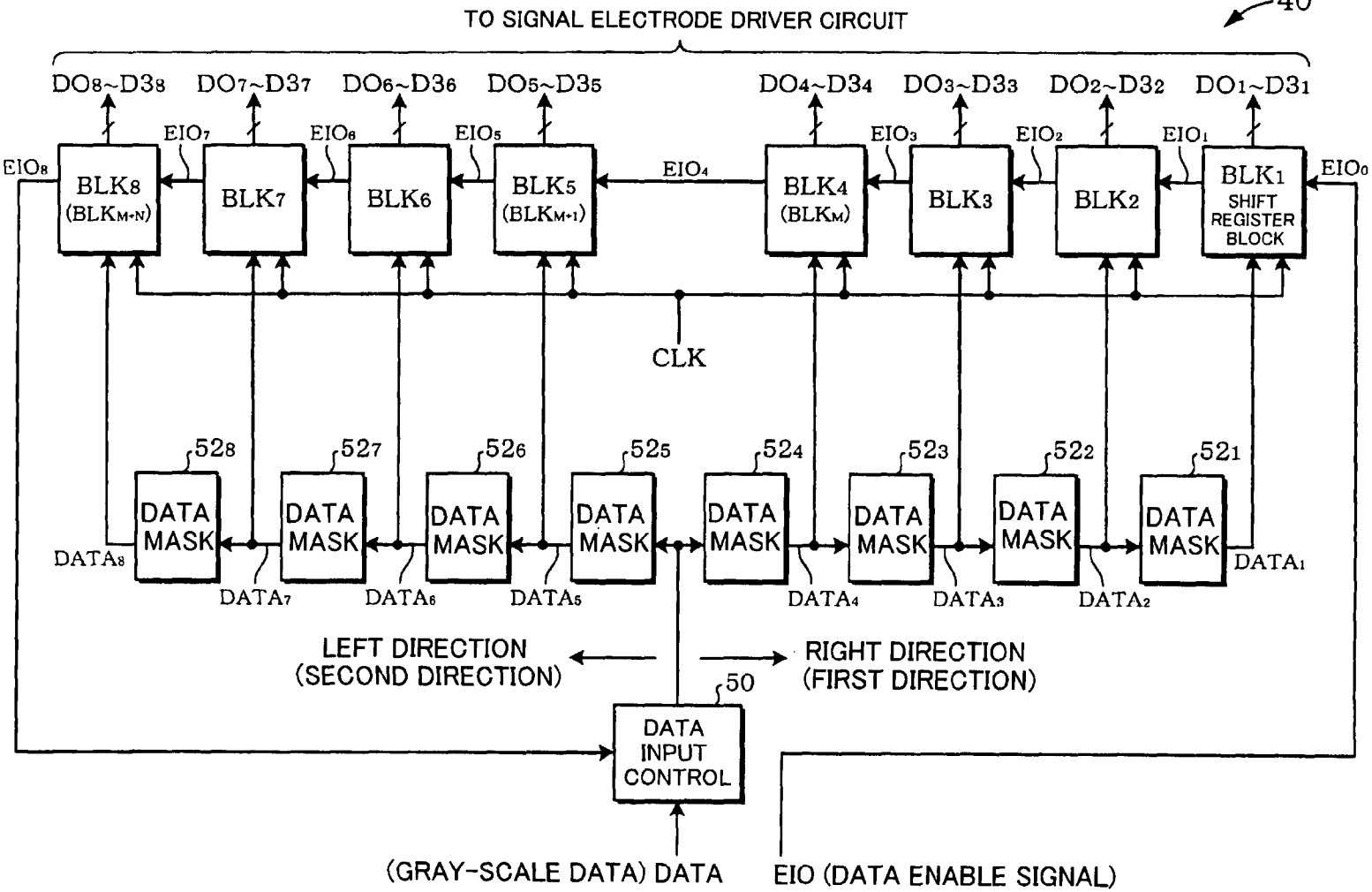
FIG. 5 is a block diagram showing an outline of a configuration of a shift register section of a display driver circuit applied to a signal driver.

FIG. 5 shows an outline of a configuration of the shift register section of the display driver circuit applied to the signal driver 30.

FIG. 5 schematically shows the layout arrangement of the shift register section in addition to the connection relationship between each circuit. FIG. 5 illustrates a state in which the shift register section 40 is formed along the direction of the long side of the signal driver (arrangement direction of the signal electrodes).

The shift register section 40 includes shift register (hereinafter abbreviated as "SR") blocks $BLK_1$ to $BLK_{M+N}$ (M and N are positive integers) divided in units of a plurality of pixels. The following description is given on the assumption that the SR blocks of the shift register section 40 are divided in units of four pixels, and the shift register section 40 includes the SR blocks $BLK_1$ to $BLK_8$ (M=N=4) for convenience of illustration. For example, the SR block $BLK_1$ latches and outputs the gray-scale data ($D0_1$, for example) consisting of 18 bits per pixel for four pixels ($D0_1$ to $D3_1$).

The input of the gray-scale data fetched by the shift register section 40 is controlled by a data input control circuit 50. The data input control circuit 50 sequentially supplies the gray-scale data input in series in units of pixels to the SR blocks $BLK_1$ to $BLK_8$ when one horizontal scanning period starts, and fixes the output of the gray-scale data to the SR blocks $BLK_1$ to $BLK_8$ when the gray-scale data for one horizontal scanning period has been fetched, thereby preventing unnecessary power consumption. The data input control circuit 50 is disposed approximately at the center in the direction of the long side of the signal driver 30.

Specifically, the SR blocks $BLK_1$ to $BLK_4$ (M=4) are disposed in a region on the right side (first direction in a broad sense) of the data input control circuit 50. The SR blocks $BLK_5$ to $BLK_8$ (N=4) are disposed in a region on the left side (second direction opposite to the first direction in a broad sense) of the data input control circuit 50.

The data enable signal EIO which is input approximately from the center in the direction of the long side of the signal driver 30 is input to the SR block $BLK_1$ as the data enable signal $EIO_0$.

The SR block $BLK_i$ ($1 \leqq i \leqq 8$) shifts the data enable signal $EIO_{i-1}$ ((i−1)th data enable signal) in synchronization with the clock signal CLK, and outputs the data enable signal to the SR block $BLK_{i+1}$ adjacent in the left direction. The data enable signal output from the SR block $BLK_i$ is output as the data enable signal $EIO_i$ (ith data enable signal).

The SR block $BLK_i$ latches the ith gray-scale data $DATA_i$ based on the (i−1)th data enable signal $EIO_{i-1}$ and the data enable signal obtained by shifting the (i−1)th data enable signal $EIO_{i-1}$. For example, the SR block $BLK_1$ shifts the 0th data enable signal $EIO_0$ in synchronization with the clock signal CLK, and latches the first gray-scale data $DATA_1$ input in series in synchronization with the shift timing based on the data enable signal. This enables the SR block $BLK_1$ to latch the gray-scale data for four pixels. The SR block $BLK_1$ outputs the first data enable signal $EIO_1$ at the next timing of the clock signal CLK.

The eighth data enable signal $EIO_8$ output from the SR block $BLK_8$ is input to the data input control circuit 50. Therefore, the data input control circuit 50 can start supplying the gray-scale data by allowing the first gray-scale data $DATA_1$ to be output to the SR block $BLK_1$ in synchronization with the 0th data enable signal $EIO_0$, and finish supplying the gray-scale data based on the eighth data enable signal $EIO_8$. Therefore, unnecessary driving of the gray-scale data is prevented by outputting the gray-scale data in a period in which the first to eighth gray-scale data $DATA_1$ to $DATA_8$ is fetched by the SR blocks $BLK_1$ to $BLK_8$, and fixing the output of the gray-scale data in a period in which the gray-scale data is not fetched, whereby power consumption can be reduced.

The shift register section 40 includes first to eighth data mask circuits $\mathbf{52}_1$ to $\mathbf{52}_8$ corresponding to the SR blocks $BLK_1$ to $BLK_8$. The first to fourth data mask circuits $\mathbf{52}_1$ to $\mathbf{52}_4$ are disposed in a region on the right side of the data input control circuit 50 and connected in order from the fourth data mask circuit $\mathbf{52}_4$, the third data mask circuit $\mathbf{52}_3$, . . . , and the first data mask circuit $\mathbf{52}_1$ in the right direction. Specifically, the fourth gray-scale data $DATA_4$ output from the fourth data mask circuit $\mathbf{52}_4$ is input to the third data mask circuit $\mathbf{52}_3$. The third gray-scale data $DATA_3$ output from the third data mask circuit $\mathbf{52}_3$ is input to the second data mask circuit $\mathbf{52}_2$. The second gray-scale data $DATA_2$ output from the second data mask circuit $\mathbf{52}_2$ is input to the first data mask circuit $\mathbf{52}_1$.

The fifth to eighth data mask circuits $\mathbf{52}_5$ to $\mathbf{52}_8$ are disposed in a region on the left side of the data input control circuit 50 and connected in order from the fifth data mask circuit $\mathbf{52}_5$, the sixth data mask circuit $\mathbf{52}_6$, . . . , and the eighth data mask circuit $\mathbf{52}_8$ in the left direction. Specifically, the fifth gray-scale data $DATA_5$ output from the fifth data mask circuit $\mathbf{52}_5$ is input to the sixth data mask circuit $\mathbf{52}_6$. The sixth gray-scale data $DATA_6$ output from the sixth data mask circuit $\mathbf{52}_6$ is input to the seventh data mask circuit $\mathbf{52}_7$. The seventh gray-scale data $DATA_7$ output from the seventh data mask circuit $\mathbf{52}_7$ is input to the eighth data mask circuit $\mathbf{52}_8$.

The first to eighth data mask circuits $\mathbf{52}_1$ to $\mathbf{52}_8$ perform mask control for the gray-scale data supplied to the SR blocks $BLK_1$ to $BLK_8$ and output the first to eighth gray-scale data $DATA_1$ to $DATA_8$. The mask control for the gray-scale data refers to control for fixing the output of the data mask circuit. In the unmasked state, the gray-scale data input to the data mask circuit is output as is from the data mask circuit. In the masked state, the output of the data mask circuit is fixed at a logic level "H" or "L" or the like.

In FIG. 5, the gray-scale data (0th gray-scale data $DATA_0$) output from the data input control circuit 50 is input to the fourth data mask circuit $\mathbf{52}_4$. The fourth data mask circuit $\mathbf{52}_4$ performs mask control for the 0th gray-scale data $DATA_0$, and outputs the fourth gray-scale data $DATA_4$. The fourth gray-scale data $DATA_4$ is input to the SR block $BLK_4$ and the third data mask circuit $\mathbf{52}_3$. If the fourth gray-scale data $DATA_4$ is input to the SR block $BLK_4$, the fourth gray-scale data $DATA_4$ is latched in a period in which the third data enable signal $EIO_3$ is output. The third data mask circuit $\mathbf{52}_3$ performs mask control for the fourth gray-scale data $DATA_4$ and generates the third gray-scale data $DATA_3$. The third gray-scale data $DATA_3$ is input to the SR block $BLK_3$ and the second data mask circuit $\mathbf{52}_2$.

Therefore, the gray-scale data input to the SR block $BLK_3$ which is input in series through the data input control circuit 50 can be supplied as the third gray-scale data $DATA_3$ from the third data mask circuit $\mathbf{52}_3$ by controlling mask control timing of the fourth and third data mask circuits $\mathbf{52}_4$ and $\mathbf{52}_3$.

The above description also applies to the second and first data mask circuits $\mathbf{52}_2$ and $\mathbf{52}_1$. However, the first gray-scale data $DATA_1$ generated by the first data mask circuit $\mathbf{52}_1$ is supplied only to the SR block $BLK_1$.

In FIG. 5, the gray-scale data (0th gray-scale data $DATA_0$) output from the data input control circuit 50 is input to the fifth data mask circuit $\mathbf{52}_5$. The fifth data mask circuit $\mathbf{52}_5$ performs mask control for the 0th gray-scale data $DATA_0$, and outputs the fifth gray-scale data $DATA_5$. The fifth gray-scale data $DATA_5$ is input to the SR block $BLK_5$ and the sixth data mask circuit $\mathbf{52}_6$. If the fifth gray-scale data $DATA_5$ is input to the SR block $BLK_5$, the fifth gray-scale data $DATA_5$ is latched in a period in which the fourth data enable signal $EIO_4$ is output. The sixth data mask circuit $\mathbf{52}_6$ performs mask control for the fifth gray-scale data $DATA_5$, and generates the sixth gray-scale data $DATA_6$. The sixth gray-scale data $DATA_6$ is input to the SR block $BLK_6$ and the seventh data mask circuit $\mathbf{52}_7$.

The above description also applies to the seventh and eighth data mask circuits $\mathbf{52}_7$ and $\mathbf{52}_8$. However, the eighth gray-scale data $DATA_8$ generated by the eighth data mask circuit $\mathbf{52}_8$ is supplied only to the SR block $BLK_8$.

In FIG. 5, in the region on the right side of the data input control circuit 50, the first to fourth gray-scale data latched based on the data enable signal shifted in the left direction is transferred in the right direction. Therefore, the gray-scale data output to the SR blocks $BLK_1$ to $BLK_4$ is masked (output is fixed) in order from the first data mask circuit $\mathbf{52}_1$, the second data mask circuit $\mathbf{52}_2$, . . . , and the fourth data mask circuit $\mathbf{52}_4$ corresponding to the shift timing of the data enable signal in block units. This makes it unnecessary to drive an unnecessary area of the gray-scale bus to which the gray-scale data is supplied taking the shift timing of each SR block into consideration, whereby unnecessary power consumption accompanying driving of the gray-scale bus can be significantly reduced.

In the region on the left side of the data input control circuit 50, the fifth to eighth gray-scale data latched based on the data enable signal shifted in the left direction is transferred in the left direction. Therefore, the gray-scale data output to the SR blocks $BLK_5$ to $BLK_8$ is unmasked in order from the fifth data mask circuit $\mathbf{52}_5$, the sixth data mask circuit $\mathbf{52}_6$, . . . , and the eighth data mask circuit $\mathbf{52}_8$ corresponding to the shift timing of the data enable signal in block units. Therefore, unnecessary power consumption accompanying driving of the gray-scale bus can be significantly reduced by sequentially driving a necessary area of the gray-scale bus to which the gray-scale data is supplied taking the shift timing of each SR block into consideration.

In FIG. 5, power consumption is reduced by performing mask control for the gray-scale data. However, power consumption may be reduced by performing mask control for a control signal bus which is disposed in the arrangement direction of the signal electrodes and connected in common with each SR block or the like.

The configuration of the display driver circuit is described below in more detail.

2.1 First Embodiment

Figure 6:
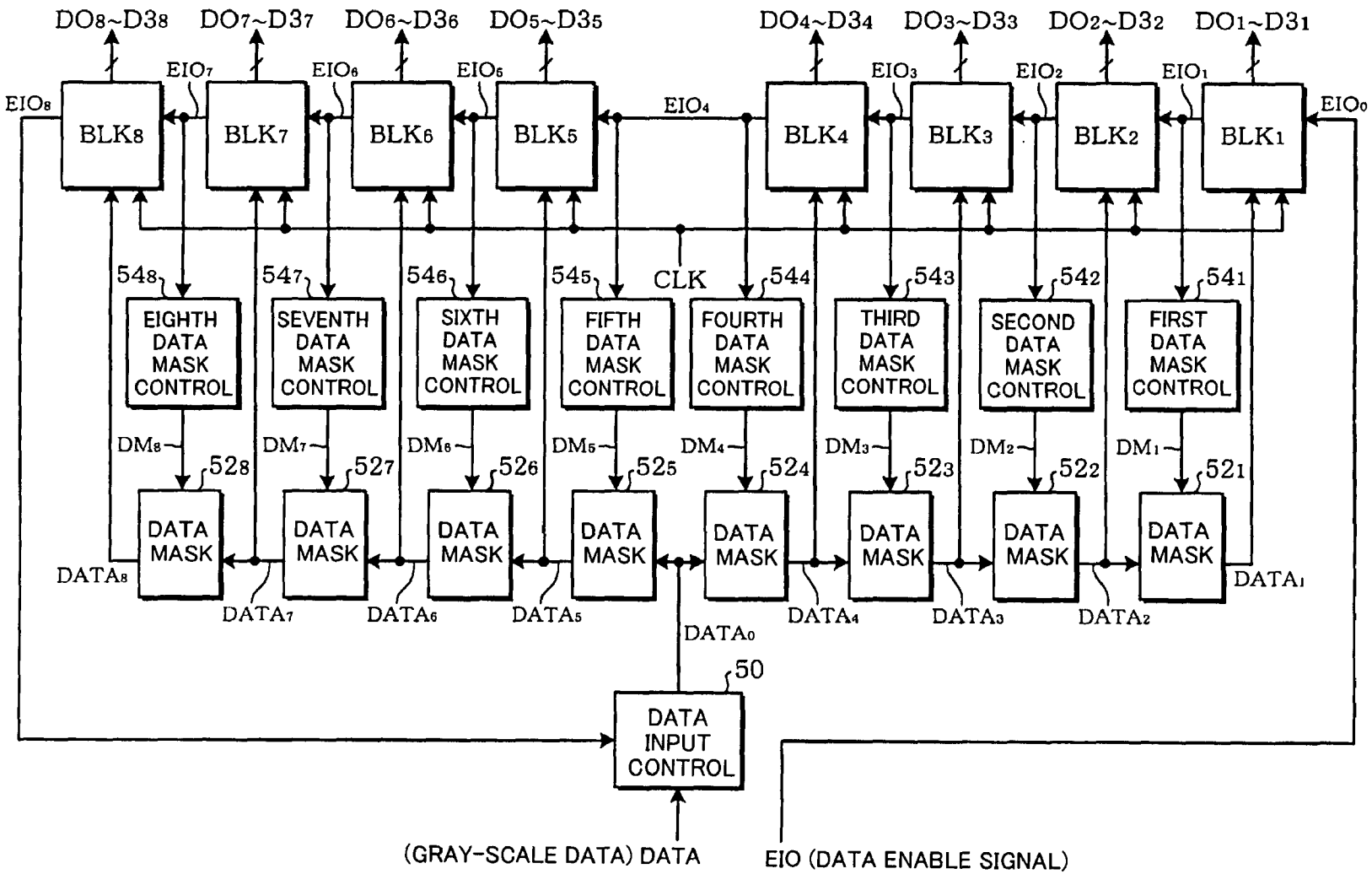
FIG. 6 is a block diagram showing an outline of a configuration of a shift register section of a display driver circuit in a first embodiment.

FIG. 6 shows an outline of a configuration of a shift register section of a display driver circuit in the first embodiment.

In FIG. 6, sections the same as those of the shift register section shown in FIG. 5 are indicated by the same symbols. Description of these sections is appropriately omitted.

The display driver circuit in the first embodiment may be applied to the signal driver shown in FIG. 3. In this case, the shift register section shown in FIG. 6 corresponds to the shift register section 40 shown in FIG. 3.

In FIG. 6, first to eighth data mask control circuits $\mathbf{54}_1$ to $\mathbf{54}_8$ are provided corresponding to the first to eighth data mask circuits $\mathbf{52}_1$ to $\mathbf{52}_8$. The first to eighth data mask control circuits $\mathbf{54}_1$ to $\mathbf{54}_8$ respectively generate first to eighth data mask control signals $DM_1$ to $DM_8$. The first to eighth data mask circuits $\mathbf{52}_1$ to $\mathbf{52}_8$ perform mask control for the gray-scale data based on the first to eighth data mask control signals $DM_1$ to $DM_8$ and output the first to eighth gray-scale data $DATA_1$ to $DATA_8$.

In the region on the right side of the data input control circuit 50, first to fourth circuit blocks including the SR blocks in a first system may be formed. In the region on the left side of the data input control circuit 50, fifth to eighth circuit blocks including the SR blocks in a second system may be formed. Since the first system and the second system differ in the mask control method as described above, the first system and the second system differ in the generation method of the data mask control signal.

2.1.1 First System

Figure 7:
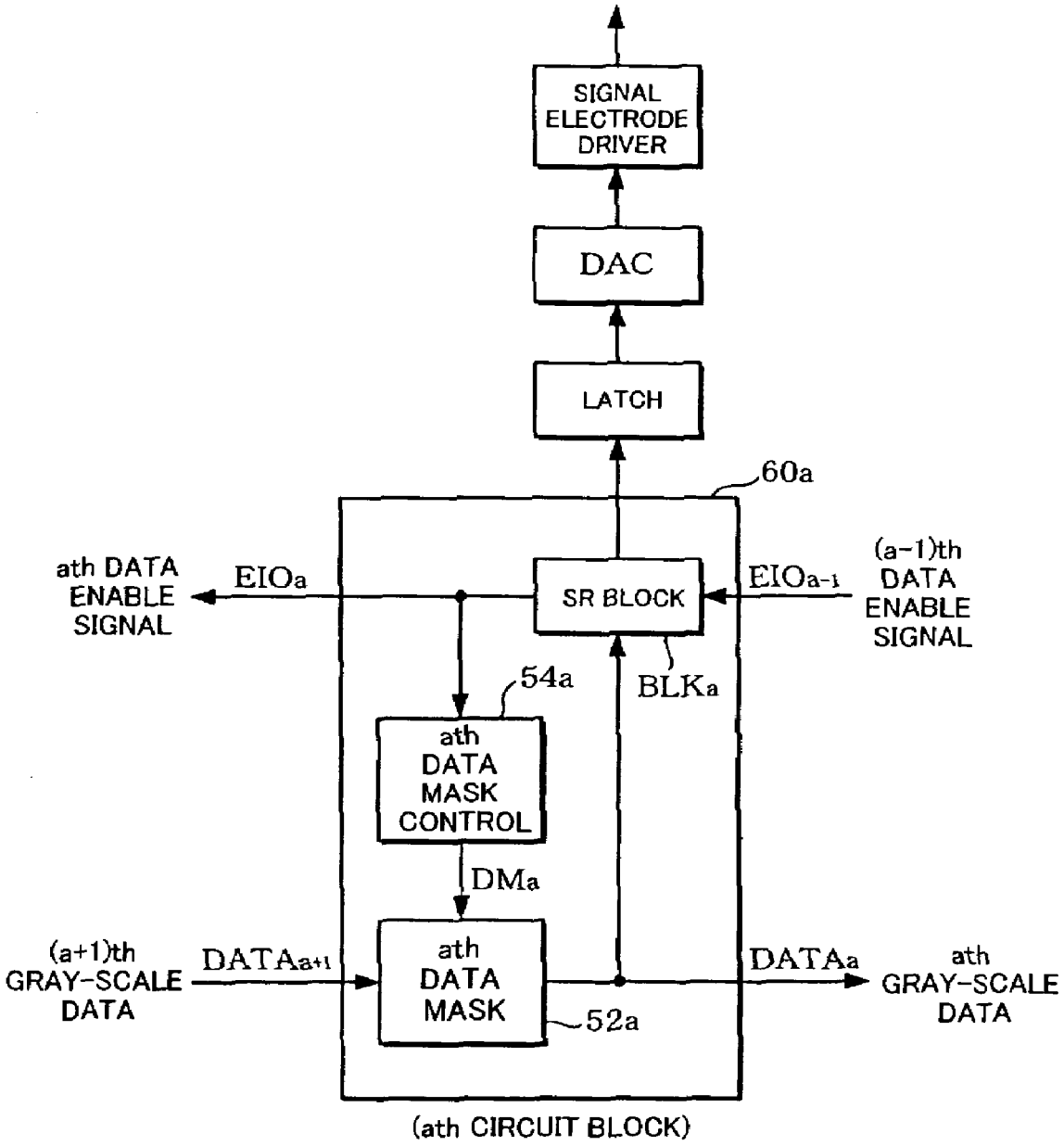
FIG. 7 is a block diagram showing an outline of a configuration of a circuit block in a first system in the first embodiment.

FIG. 7 shows an outline of a configuration of a circuit block in the first system in the first embodiment.

FIG. 7 shows an ath ($1 \leqq a \leqq M$ (=4); a is an integer) circuit block $\mathbf{60}_a$. The ath circuit block includes the SR block $BLK_a$, the ath data mask circuit $\mathbf{52}_a$, and the ath data mask control circuit $\mathbf{54}_a$.

The ath data mask control circuit $\mathbf{54}_a$ generates the ath data mask control signal $DM_a$ based on the data enable signal $EIO_a$ (ath data enable signal) output from the SR block $BLK_a$.

The ath data mask circuit $\mathbf{52}_a$ performs mask control for the (a+1)th gray-scale data $DATA_{a+1}$ by using the ath data mask control signal $DM_a$, and generates the ath gray-scale data $DATA_a$.

In the first system, the first to fourth data mask circuits $\mathbf{52}_1$ to $\mathbf{52}_4$ sequentially set the gray-scale data to the masked state from the unmasked state.

The ath gray-scale data $DATA_a$ for which mask control is performed is latched by the SR block $BLK_a$ at the shift timing of the (a−1)th data enable signal $EIO_{a-1}$. The gray-scale data for four pixels is read from the SR block $BLK_a$ and latched by the line latch. A drive voltage corresponding to the latched gray-scale data is then generated and output from the signal electrode driver circuit.

2.1.2 Second System

Figure 8:
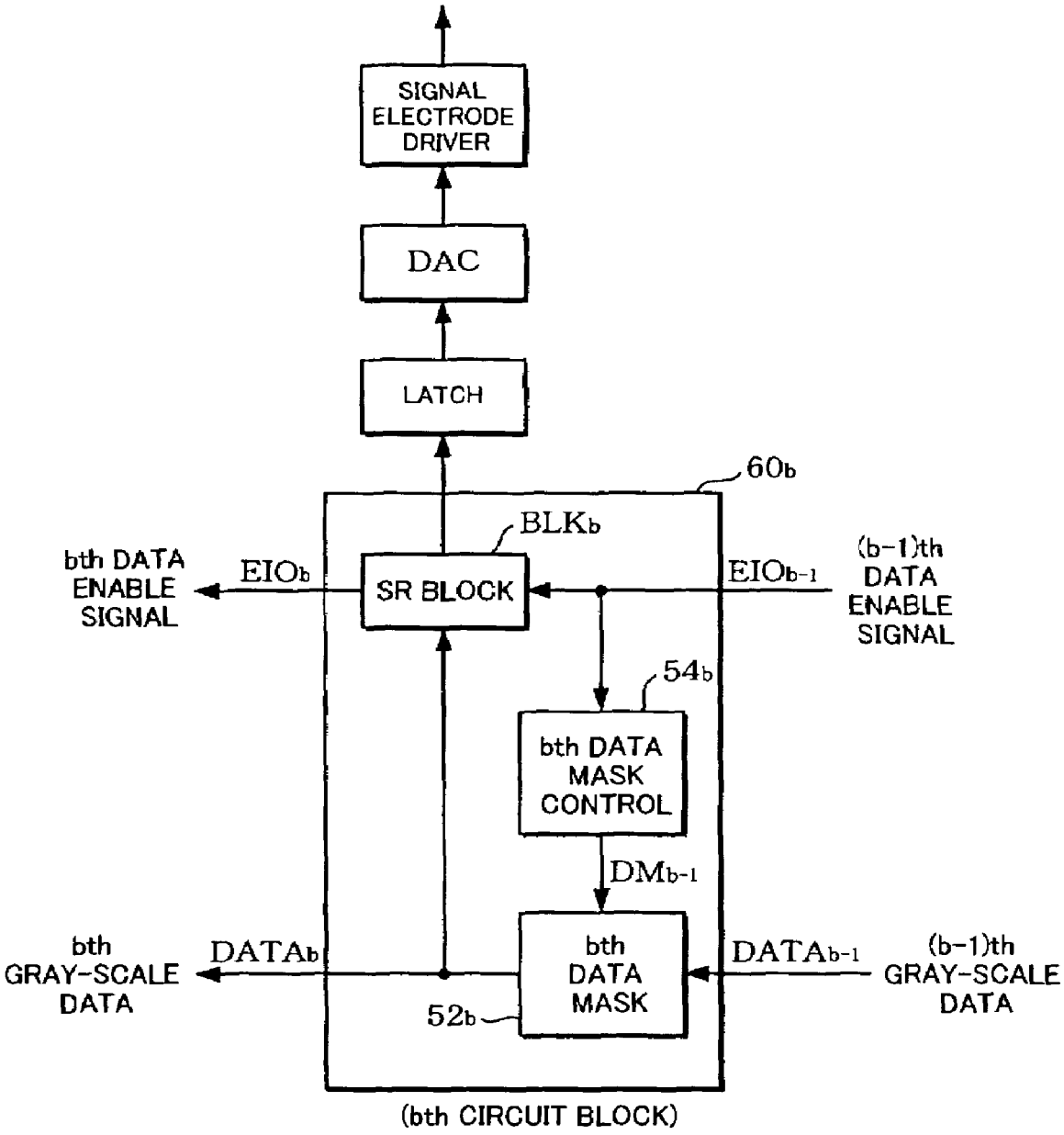
FIG. 8 is a block diagram showing an outline of a configuration of a circuit block in a second system in the first embodiment.

FIG. 8 shows an outline of a configuration of a circuit block in the second system in the first embodiment.

FIG. 8 shows a bth ($M+1(=5) \leqq b \leqq M+N(=8)$; b is an integer) circuit block $\mathbf{60}_b$. The bth circuit block includes the SR block $BLK_b$, the bth data mask circuit $\mathbf{52}_b$, and the bth data mask control circuit $\mathbf{54}_b$.

The bth data mask control circuit $\mathbf{54}_b$ generates the bth data mask control signal $DM_b$ based on the data enable signal $EIO_{b-1}$ ((b−1)th data enable signal) output from the SR block $BLK_{b-1}$.

The bth data mask circuit $\mathbf{52}_b$ performs mask control for the (b−1)th gray-scale data $DATA_{b-1}$ by using the bth data mask control signal $DM_b$ and generates the bth gray-scale data $DATA_b$.

In the second system, the fifth to eighth data mask circuits $\mathbf{52}_5$ to $\mathbf{52}_8$ sequentially set the gray-scale data to the unmasked state from the masked state.

The bth gray-scale data $DATA_b$ for which mask control is performed is latched by the SR block $BLK_b$ at the shift timing of the (b−1)th data enable signal $EIO_{b-1}$. The gray-scale data for four pixels is read from the SR block $BLK_b$ and latched by the line latch. A drive voltage corresponding to the latched gray-scale data is generated and output from the signal electrode driver circuit.

2.1.3 Timing Example

Figure 9:
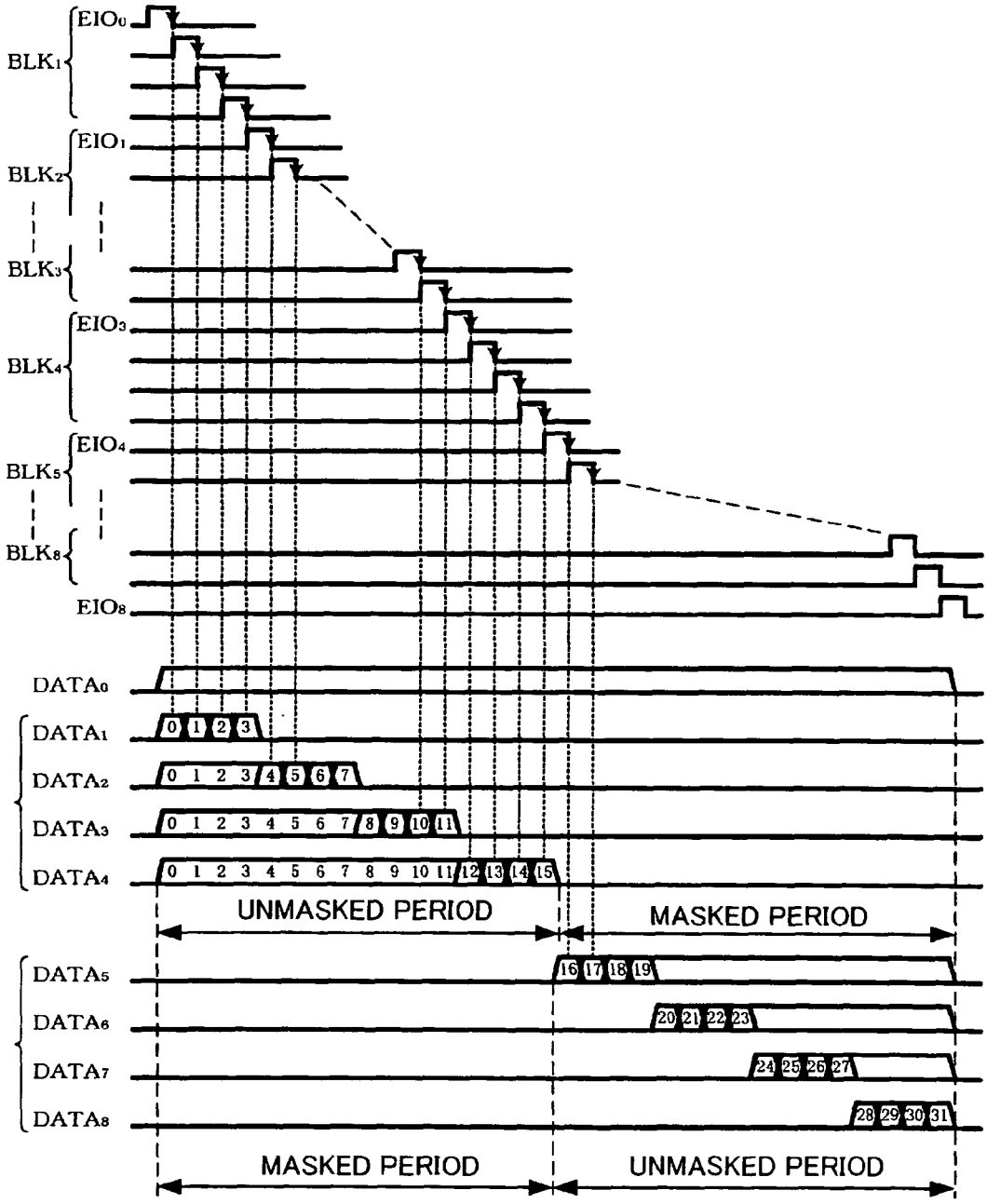
FIG. 9 is a timing chart showing an example of fetch timing of gray-scale data in the first embodiment.

FIG. 9 shows an example of fetch timing of the gray-scale data of the display driver circuit shown in FIG. 6.

The 0th to seventh data enable signals $EIO_0$ to $EIO_7$ are input to the SR blocks $BLK_1$ to $BLK_8$. Each SR block shifts the data enable signal input thereto and sequentially outputs the data enable signal to the adjacent SR block. Each SR block latches the gray-scale data input thereto at a falling edge of the shifted data enable signal.

The data input control circuit 50 outputs the gray-scale data to the fourth and fifth data mask circuits $\mathbf{52}_4$ and $\mathbf{52}_5$ at the input timing of the 0th data enable signal $EIO_0$. Since the fourth data mask circuit $\mathbf{52}_4$ is set to the unmasked state, the gray-scale data input to the fourth data mask circuit $\mathbf{52}_4$ is output as is to the third data mask circuit $\mathbf{52}_3$. The gray-scale data output through the third, second, and first data mask circuits $\mathbf{52}_3$, $\mathbf{52}_2$, and $\mathbf{52}_1$ is output to the SR block $BLK_1$ as the first gray-scale data $DATA_1$. The gray-scale data for four pixels is sequentially fetched in the SR block $BLK_1$.

Since the fifth data mask circuit $\mathbf{52}_5$ is set to the masked state, the output of the fifth data mask circuit $\mathbf{52}_5$ is fixed at a logic level "L". Therefore, the gray-scale data output from the data input control circuit 50 is not supplied to the sixth, seventh, and eighth data mask circuits $\mathbf{52}_6$, $\mathbf{52}_7$, and $\mathbf{52}_8$.

The gray-scale data corresponding to the SR block $BLK_2$ is output from the second data mask circuit $\mathbf{52}_2$ in the same manner as described above. The first data mask control circuit $\mathbf{54}_1$ generates the first data mask control signal $DM_1$ based on the first data enable signal $EIO_1$ output from the SR block $BLK_1$. The first data mask circuit $\mathbf{52}_1$ fixes the output thereof at a logic level "L" by using the first data mask control signal $DM_1$ at the next shift timing of the data enable signal.

The third and fourth data mask circuits $\mathbf{52}_3$ and $\mathbf{52}_4$ sequentially fix the outputs thereof at a logic level "L" in the same manner as described above.

As a result, the first to fourth gray-scale data $DATA_1$ to $DATA_4$ in the first system is set as shown in FIG. 9.

Specifically, the first gray-scale data $DATA_1$ is unmasked only in a period until the gray-scale data is fetched by the SR block $BLK_1$ and is then masked. The second gray-scale data $DATA_2$ is unmasked only in a period until the gray-scale data is fetched by the SR blocks $BLK_1$ and $BLK_2$ and is then masked. The third gray-scale data $DATA_3$ is unmasked only in a period until the gray-scale data is fetched by the SR blocks $BLK_1$ to $BLK_3$ and is then masked. The fourth gray-scale data $DATA_4$ is unmasked only in a period until the gray-scale data is fetched by the SR blocks $BLK_1$ to $BLK_4$ and is then masked.

When the fourth data enable signal $EIO_4$ is output from the SR block $BLK_4$, the output of the fifth data mask circuit $\mathbf{52}_5$ is unmasked by using the fifth data mask control signal $DM_5$ generated by the fifth data mask control circuit $\mathbf{54}_5$. The gray-scale data corresponding to the SR block $BLK_5$ is input from the data input control circuit 50. Therefore, the SR block $BLK_5$ latches the fifth gray-scale data $DATA_5$. The output of the sixth data mask circuit $\mathbf{52}_6$ remains in the masked state at this stage.

When the fifth data enable signal $EIO_5$ is output from the SR block $BLK_5$, the output of the sixth data mask circuit $\mathbf{52}_6$ is unmasked by using the sixth data mask control signal $DM_6$ generated by the sixth data mask control circuit $\mathbf{54}_6$. The gray-scale data corresponding to the SR block $BLK_6$ is input from the data input control circuit 50 through the fifth data mask circuit $\mathbf{52}_5$ which remains in the unmasked state. Therefore, the SR block $BLK_6$ latches the sixth gray-scale data $DATA_6$. The output of the seventh data mask circuit $\mathbf{52}_7$ remains in the masked state at this stage.

The SR blocks $BLK_7$ and $BLK_8$ sequentially latch the seventh and eighth gray-scale data $DATA_7$ and $DATA_8$ in the same manner as described above.

As a result, the fifth to eighth gray-scale data $DATA_5$ to $DATA_8$ in the second system is set as shown in FIG. 9.

Specifically, the eighth gray-scale data $DATA_8$ is unmasked only in a period until the gray-scale data is fetched by the SR block $BLK_8$ and is then masked. The seventh gray-scale data $DATA_7$ is unmasked only in a period until the gray-scale data is fetched by the SR blocks $BLK_7$ and $BLK_8$ and is then masked. The sixth gray-scale data $DATA_6$ is unmasked only in a period until the gray-scale data is fetched by the SR blocks $BLK_6$ to $BLK_8$ and is then masked. The fifth gray-scale data $DATA_5$ is unmasked only in a period until the gray-scale data is fetched by the SR blocks $BLK_5$ to $BLK_8$ and is then masked.

2.1.4 Comparative Example

The effects of the first embodiment are described below by contrast with a comparative example.

Figure 10A:
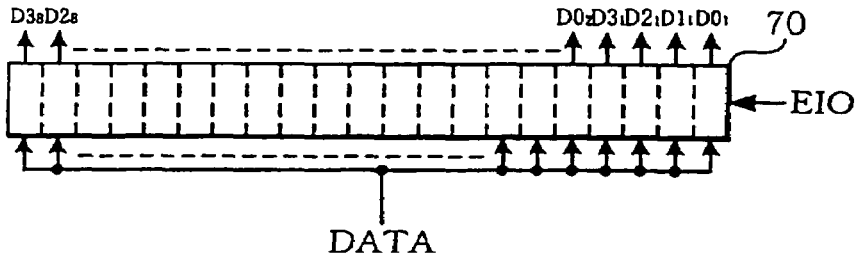
FIG. 10A RELATED ART
FIG. 10A is a block diagram showing an outline of a configuration of a shift register section in a comparative example.

FIG. 10A shows an example of a configuration of a shift register section in the comparative example.

A shift register section 70 in the comparative example shifts the data enable signal EIO, and sequentially fetches the gray-scale data on the gray-scale bus connected in common with each flip-flop based on the shifted data enable signal.

Figure 10B:
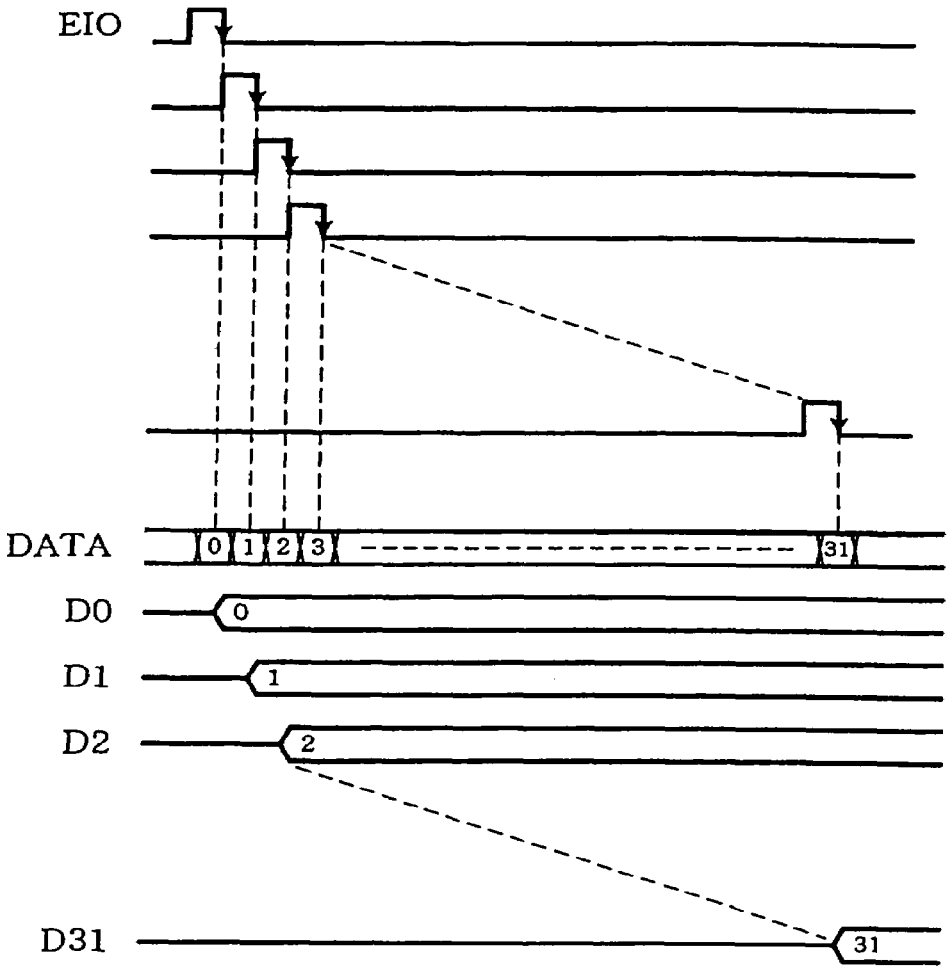
FIG. 10B is a timing chart showing an example of operation timing of a shift register section in the comparative example.

FIG. 10B shows an example of operation timing of the shift register section in the comparative example.

The gray-scale data is supplied in series to the gray-scale bus in units of pixels. Therefore, each flip-flop fetches the gray-scale data on the gray-scale bus each time the data enable signal EIO is shifted.

As shown in FIG. 10A, the gray-scale bus is connected in common with each flip-flop of the shift register section 70. Therefore, the gray-scale bus is repeatedly driven to logic levels "H" and "L" corresponding to the value of the gray-scale data to be held until the gray-scale data for one horizontal scanning period is latched. Specifically, the gray-scale bus is continuously driven until the gray-scale data for the final pixel in one horizontal scanning period is latched, even though it is unnecessary to drive the gray-scale bus connected with the flip-flop for the first pixel after the gray-scale data for the first pixel has been latched.

In the first embodiment, unnecessary power consumption accompanying the driving of the gray-scale bus can be significantly reduced by not driving an unnecessary area of the gray-scale bus in the first system and sequentially driving a necessary area of the gray-scale bus in the second system, as shown in FIG. 9.

2.1.5 Detailed Circuit Configuration Example

Figure 11:
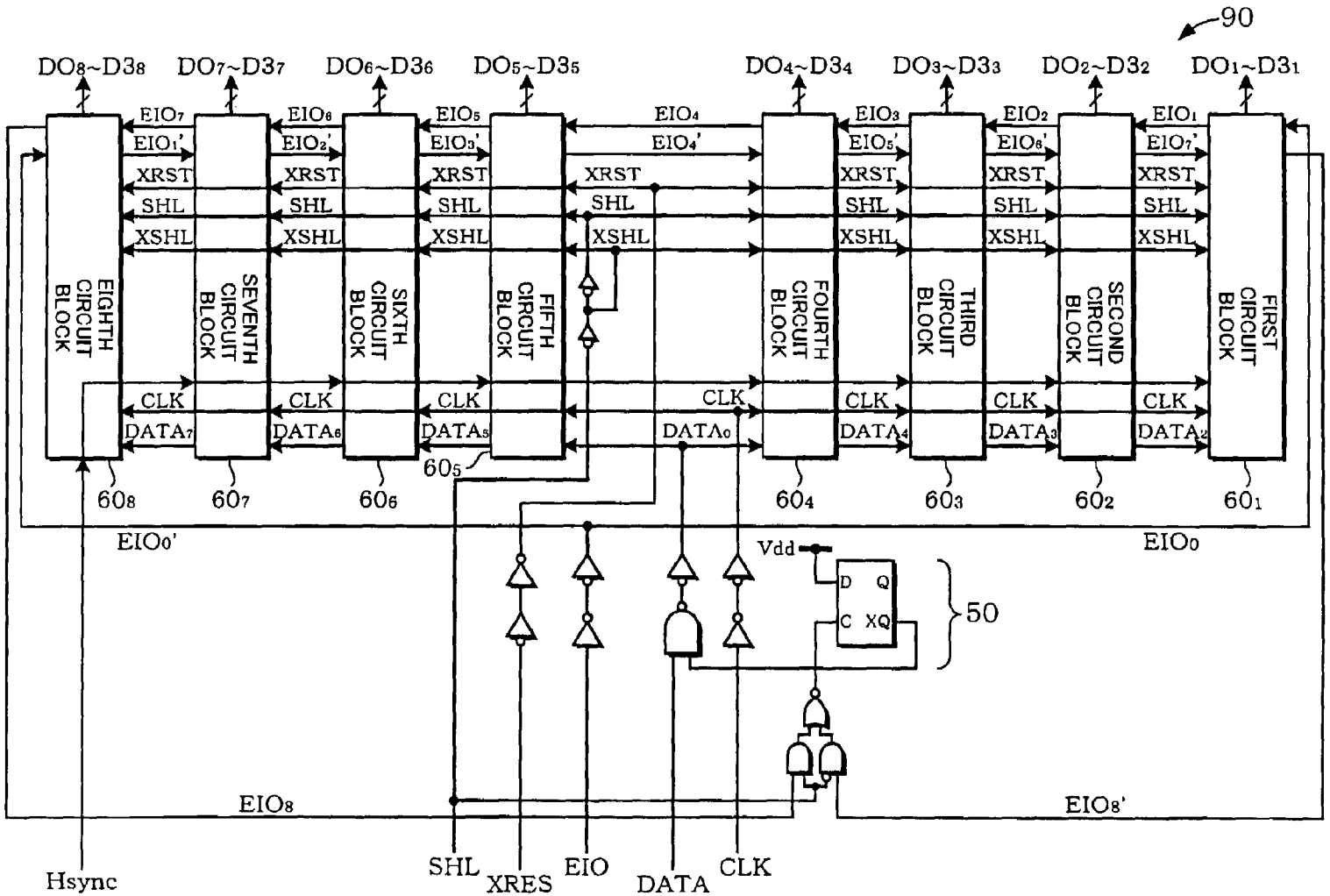
FIG. 11 is an entire block diagram of a detailed configuration example of a shift register section of a display driver circuit in the first embodiment.

FIG. 11 shows an entire block diagram of a configuration example of the shift register section of the display driver circuit in the first embodiment.

A shift register section 90 corresponds to the shift register section 40 shown in FIG. 3. The shift register section 90 includes first to fourth circuit blocks $\mathbf{60}_1$ to $\mathbf{60}_4$ in the first system having the configuration shown in FIG. 7, and fifth to eighth circuit blocks $\mathbf{60}_5$ to $\mathbf{60}_8$ in the second system having the configuration shown in FIG. 8.

The shift signal SHL is input to the shift register section 90 and supplied to the first to eighth circuit blocks $\mathbf{60}_1$ to $\mathbf{60}_8$. The shift direction of the first to eighth circuit blocks $\mathbf{60}_1$ to $\mathbf{60}_8$ can be changed to either the first direction or the second direction corresponding to the logic level of the shift signal SHL.

Flip-flops of the first to eighth circuit blocks $\mathbf{60}_1$ to $\mathbf{60}_8$ are initialized based on the horizontal synchronization signal Hsync input to the shift register section 90. The internal states of the first to eighth circuit blocks $\mathbf{60}_1$ to $\mathbf{60}_8$ are initialized based on the reset signal XRES input to the shift register section 90.

The output of the gray-scale data input to the shift register section 90 is controlled by the data input control circuit 50. The data input control circuit 50 includes a flip-flop which is connected with a power supply potential at a data terminal D. The output of the gray-scale data DATA is controlled by an inverted output terminal XQ of the flip-flop. The flip-flop latches the level of the data terminal D based on the data enable signal $EIO_8$ or the data enable signal $EIO_8'$ corresponding to the shift signal SHL.

The 0th data enable signal $EIO_0$ input to the first circuit block $\mathbf{60}_1$ is shifted and output from the eighth circuit block $\mathbf{60}_8$ as the eighth data enable signal $EIO_8$. The data enable signal $EIO_0'$ input to the eighth circuit block $\mathbf{60}_8$ is shifted and output from the first circuit block $\mathbf{60}_1$ as the data enable signal $EIO_8'$. The first to eighth circuit blocks $\mathbf{60}_1$ to $\mathbf{60}_8$ shift the data enable signal in the first direction when the shift signal SHL is at a first level, and shift the data enable signal in the second direction when the shift signal SHL is at a second level.

Figure 12:
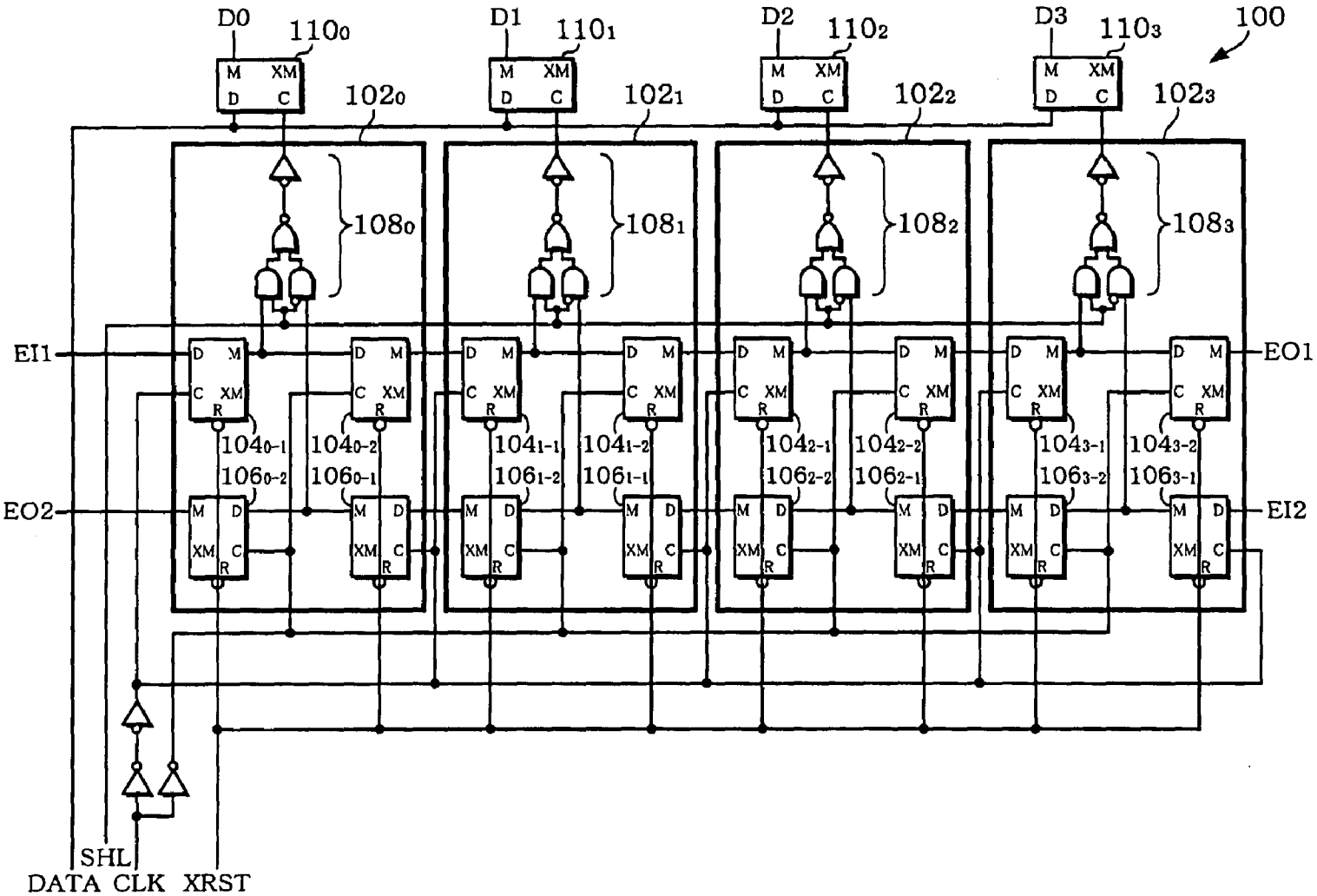
FIG. 12 is a circuit diagram showing an example of a configuration of an SR block.

FIG. 12 shows an example of a circuit configuration of the SR block included in the first circuit block.

The SR blocks included in the first to eighth circuit blocks $\mathbf{60}_1$ to $\mathbf{60}_8$ may have the same configuration. Although the gray-scale data consists of 18 bits per pixel in practical application, FIG. 12 simplifies the circuit in units of pixels.

An SR block 100 includes gray-scale data holding sections $\mathbf{102}_0$ to $\mathbf{102}_3$ provided in units of pixels. The gray-scale data holding section $\mathbf{102}_i$ ($0 \leqq i \leqq 3$; i is an integer) includes latch circuits $\mathbf{104}_{i-1}$, $\mathbf{104}_{i-2}$, $\mathbf{106}_{i-1}$, and $\mathbf{106}_{i-2}$. Each of the latch circuits is a level latch circuit which outputs a signal input through a D terminal from an M terminal in a period in which a signal input to a C terminal is at a logic level "H", and holds the logic level of the D terminal when the logic level of the signal input to the C terminal is changed to "L".

In the gray-scale data holding section $\mathbf{102}_i$, the M terminal of the latch circuit $\mathbf{104}_{i-1}$ is connected with the D terminal of the latch circuit $\mathbf{104}_{i-2}$. The M terminal of the latch circuit $\mathbf{104}_{i-1}$ is connected with an input terminal of a selector circuit $\mathbf{108}_i$.

As shown in FIG. 12, the data enable signal input from an input terminal EI1 to the D terminal of the latch circuit $\mathbf{104}_{0-1}$ of the gray-scale data holding section $\mathbf{102}_0$ is held by each latch circuit in each half-period of the clock signal CLK, and output from the M terminal of the latch circuit $\mathbf{104}_{3-2}$ of the gray-scale data holding section $\mathbf{102}_3$.

In the gray-scale data holding section $\mathbf{102}_i$, the M terminal of the latch circuit $\mathbf{106}_{i-1}$ is connected with the D terminal of the latch circuit $\mathbf{106}_{i-2}$. The M terminal of the latch circuit $\mathbf{106}_{i-1}$ is connected with the other input terminal of the selector circuit $\mathbf{108}_i$.

As shown in FIG. 12, the data enable signal input from an input terminal EI2 to the D terminal of the latch circuit $\mathbf{106}_{3-1}$ of the gray-scale data holding section $\mathbf{102}_3$ is held by each latch circuit in each half-period of the clock signal CLK, and output from the M terminal of the latch circuit $\mathbf{106}_{0-2}$ of the gray-scale data holding section $\mathbf{102}_0$.

The selector circuits $\mathbf{108}_0$ to $\mathbf{108}_3$ select the outputs of the M terminals of the latch circuits $\mathbf{106}_{0-1}$ to $\mathbf{106}_{3-1}$ when the shift signal SHL is at a logic level "H", and select the outputs of the M terminals of the latch circuits $\mathbf{104}_{0-1}$ to $\mathbf{104}_{3-1}$ when the shift signal SHL is at a logic level "L". The outputs of the selector circuits $\mathbf{108}_0$ to $\mathbf{108}_3$ are connected with C terminals of gray-scale data latch circuits $\mathbf{110}_0$ to $\mathbf{110}_1$. The gray-scale bus to which the gray-scale data DATA is supplied is connected with D terminals of the gray-scale data latch circuits $\mathbf{110}_0$ to $\mathbf{110}_1$. The gray-scale data D0 to D3 held in the gray-scale data latch circuits $\mathbf{110}_0$ to $\mathbf{110}_1$ is output from M terminals of the gray-scale data latch circuits $\mathbf{110}_0$ to $\mathbf{110}_1$.

As described above, the SR block shifts the data enable signal in each half-period of the clock signal CLK, and holds the gray-scale data on the gray-scale bus based on the shifted data enable signal.

The SR blocks of each circuit block in the second system may be realized by using the same configuration as that shown in FIG. 12.

Figure 13:
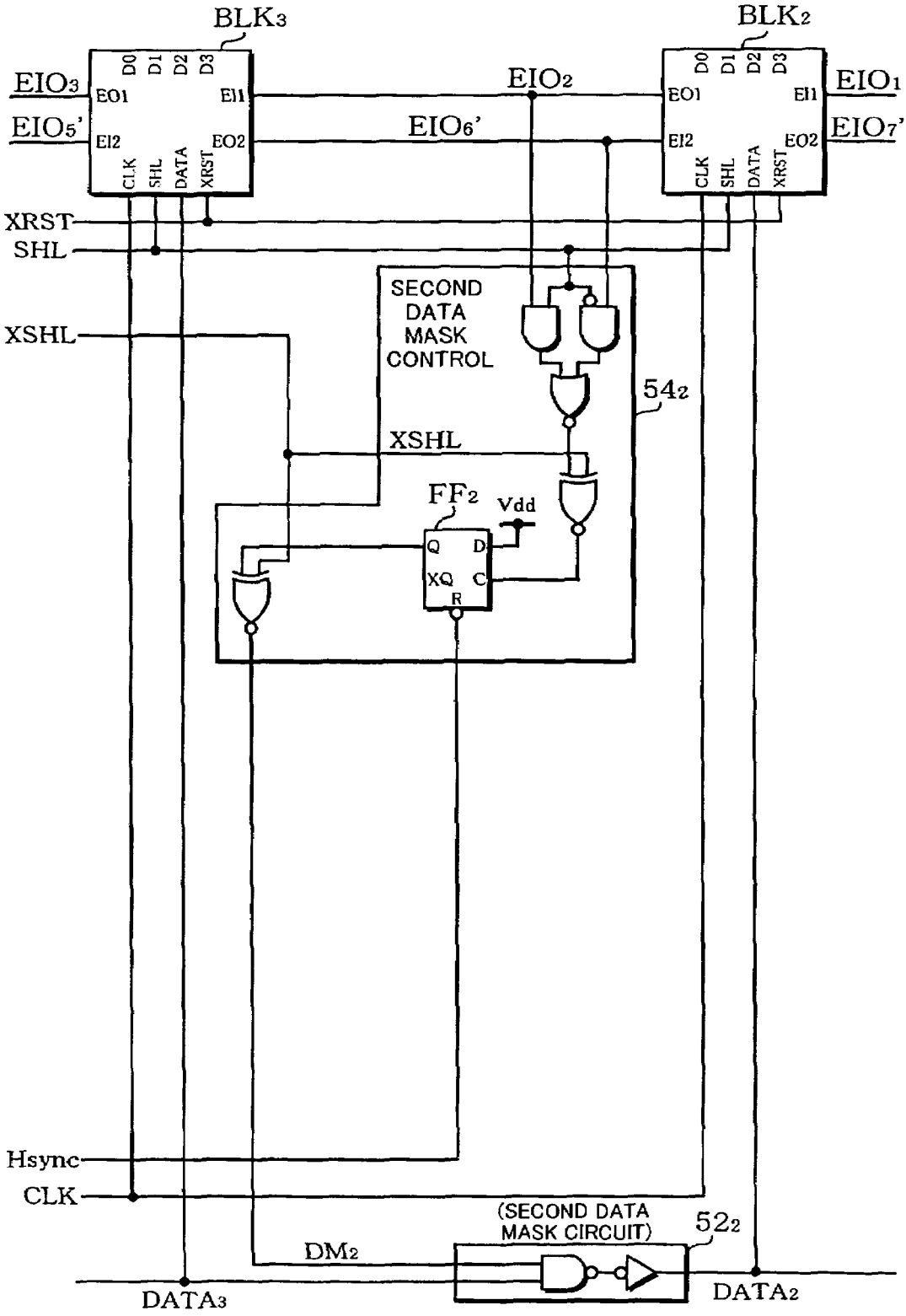
FIG. 13 is a circuit diagram showing a configuration example of a data mask control circuit and a data mask circuit.

FIG. 13 shows a circuit configuration example of the data mask control circuit and the data mask circuit.

FIG. 13 illustrates a configuration example of the second data mask control circuit $\mathbf{54}_1$ and the second data mask circuit $\mathbf{52}_2$ in the first system. However, the other data mask control circuits and data mask circuits in the first system and the data mask control circuits and the data mask circuits in the second system may be realized by using the same configuration as that shown in FIG. 13.

The second data mask control circuit $\mathbf{54}_2$ inverts the phase of the data enable signal output from the SR block $BLK_2$ or $BLK_3$ corresponding to the logic level of the shift signal SHL in response to an inverted shift signal XSHL which is an inverted signal of the shift signal SHL, and inputs the data enable signal to a C terminal of a flip-flop $FF_2$. A D terminal of the flip-flop $FF_2$ is connected with the power supply potential Vdd. The horizontal synchronization signal Hsync is input to an R terminal of the flip-flop $FF_2$. The output of a Q terminal of the flip-flop $FF_2$ is inverted corresponding to the inverted shift signal XSHL, and output as the second data mask control signal $DM_2$.

The second data mask circuit $\mathbf{52}_2$ calculates a logical AND of the third gray-scale data $DATA_3$ and the second data mask control signal $DM_2$ and outputs the result as the second gray-scale data $DATA_2$.

As described above, the second data mask control circuit $\mathbf{54}_2$ sets the flip-flop $FF_2$ by using the data enable signal output from the SR block $BLK_2$ or $BLK_3$ corresponding to the shift direction, and masks the third gray-scale data $DATA_3$ by using the second data mask circuit $\mathbf{52}_2$ during the horizontal scanning period.

Figure 14:
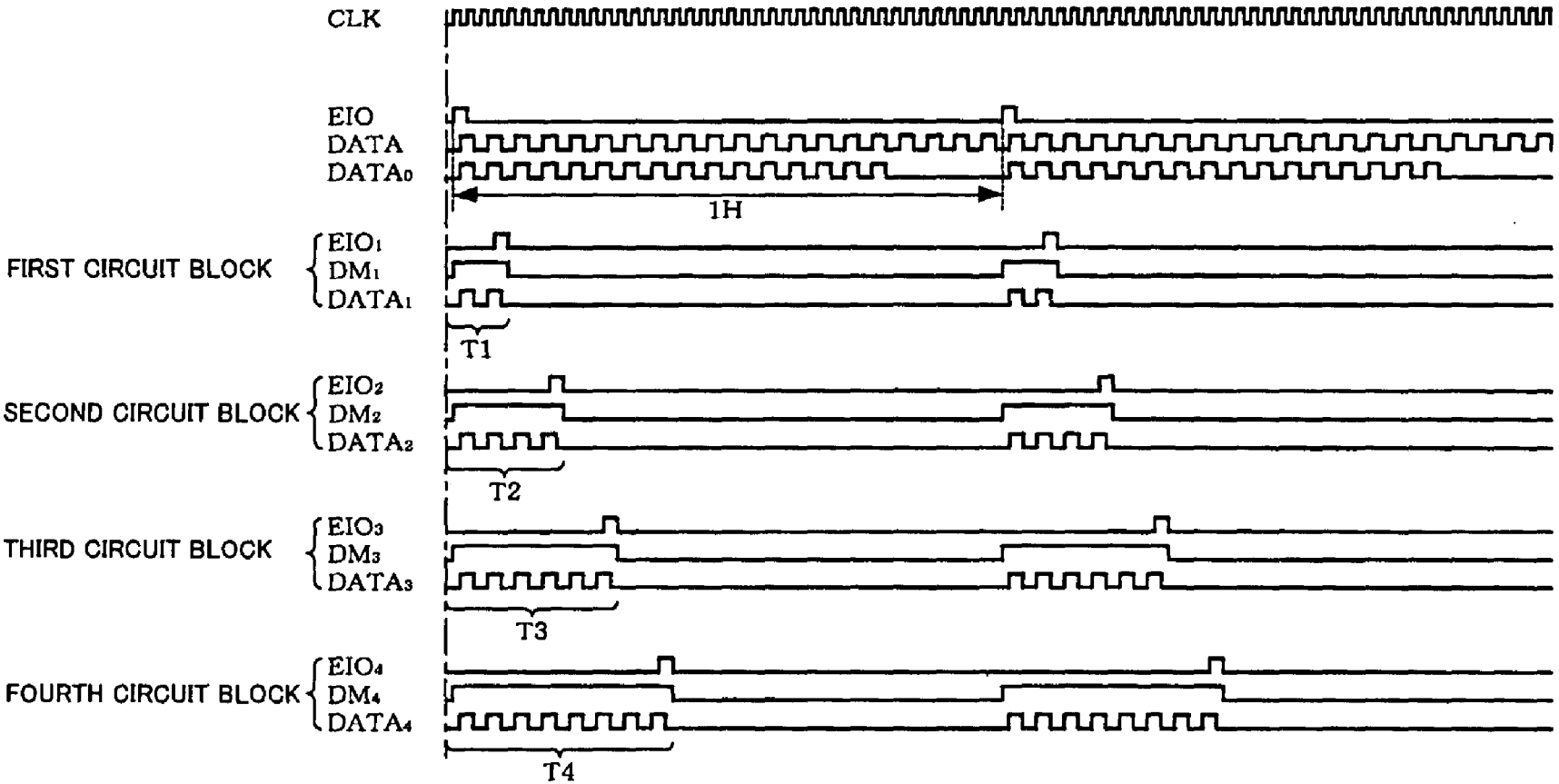
FIG. 14 is a timing chart showing an example of operation timing of a circuit block in a first system in the first embodiment.

FIG. 14 shows an example of operation timing of the circuit block in the first system.

When the data enable signal EIO is input and the gray-scale data DATA is sequentially input in units of pixels, the data input control circuit 50 outputs the 0th gray-scale data $DATA_0$ to the fourth and the fifth circuit blocks $\mathbf{60}_4$ and $\mathbf{60}_5$.

In the first to fourth circuit blocks $\mathbf{60}_1$ to $\mathbf{60}_4$, the data enable signal EIO is shifted in the direction from the first circuit block $\mathbf{60}_1$ to the fourth circuit block $\mathbf{60}_4$ as the 0th data enable signal $EIO_0$. Therefore, the first data mask circuit $\mathbf{52}_1$ unmasks the first gray-scale data $DATA_1$ until the first data enable signal $EIO_1$ is output, and masks the first gray-scale data $DATA_1$ when the first data enable signal $EIO_1$ is output (T1).

The second data mask circuit $\mathbf{52}_2$ of the second circuit block $\mathbf{60}_2$ unmasks the second gray-scale data $DATA_2$ until the second data enable signal $EIO_2$ is output, and masks the second gray-scale data $DATA_2$ when the second data enable signal $EIO_2$ is output (T2).

The above mask control is also performed in the third and fourth circuit blocks $\mathbf{60}_3$ and $\mathbf{60}_4$. As described above, the first to fourth data mask circuits $\mathbf{52}_1$ to $\mathbf{52}_4$ unmask the first to fourth gray-scale data $DATA_1$ to $DATA_4$ until the first to fourth data enable signals $EIO_1$ to $EIO_4$ are output, and mask the first to fourth gray-scale data $DATA_1$ to $DATA_4$ when the first to fourth data enable signals $EIO_1$ to $EIO_4$ are output (T1 to T4). Therefore, since it suffices to drive the bus only at the timing necessary for supplying the gray-scale data, unnecessary power consumption can be significantly reduced.

Figure 15:
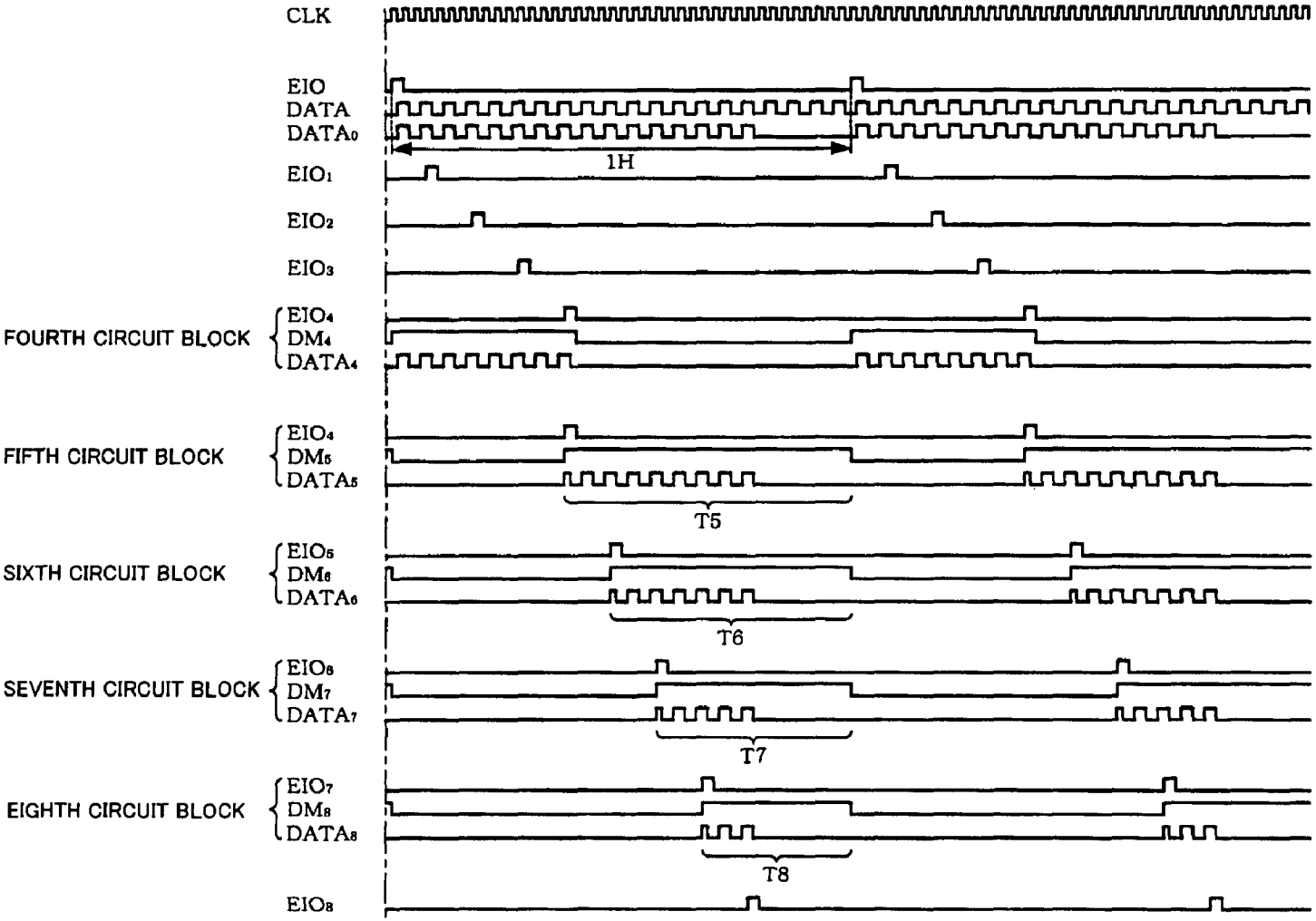
FIG. 15 is a timing chart showing an example of operation timing of a circuit block in a second system in the first embodiment.

FIG. 15 shows an example of operation timing of the second system.

When the data enable signal EIO is input and the gray-scale data DATA is sequentially input in units of pixels, the data input control circuit 50 outputs the 0th gray-scale data $DATA_0$ to the fourth and fifth circuit blocks $\mathbf{60}_4$ and $\mathbf{60}_5$.

The following description illustrates the case where the fifth to eighth circuit blocks $\mathbf{60}_5$ to $\mathbf{60}_8$ in the second system shift the fourth data enable signal $EIO_4$ output from the fourth circuit block $\mathbf{60}_4$ in the direction from the fifth circuit block $\mathbf{60}_5$ to the eighth circuit block $\mathbf{60}_4$.

The fifth data mask circuit $\mathbf{52}_5$ unmasks the 0th gray-scale data $DATA_0$ after the fourth data enable signal $EIO_4$ is output and then outputs the fifth gray-scale data $DATA_5$. The unmasked state is maintained until at least the eighth data enable signal $EIO_8$ is output (until one horizontal scanning period ends in FIG. 15) (T5).

The sixth data mask circuit $\mathbf{52}_6$ of the sixth circuit block $\mathbf{60}_6$ unmasks the fifth gray-scale data $DATA_5$ after the fifth data enable signal $EIO_5$ is output and then outputs the sixth gray-scale data $DATA_6$. The unmasked state is maintained until at least the eighth data enable signal $EIO_8$ is output (until one horizontal scanning period ends in FIG. 15) (T6).

The above mask control is also performed in the seventh and the eighth circuit blocks $\mathbf{60}_7$ and $\mathbf{60}_8$. As described above, the fifth to eighth data mask circuits $\mathbf{52}_5$ to $\mathbf{52}_8$ unmask the 0th gray-scale data $DATA_0$ and the fifth to seventh gray-scale data $DATA_5$ to $DATA_7$ after the fourth to seventh data enable signals $EIO_4$ to $EIO_7$ are output and then output the fifth to eighth gray-scale data $DATA_5$ to $DATA_8$. The unmasked state is maintained until at least the eighth data enable signal $EIO_8$ is output (until one horizontal scanning period ends in FIG. 15) (T5 to T8). Therefore, since it suffices to drive the bus only at the timing necessary for supplying the gray-scale data, unnecessary power consumption can be significantly reduced.

Moreover, it is unnecessary for the data input control circuit 50 to drive the gray-scale data through the entire horizontal scanning period (1H). Specifically, it is unnecessary to drive the gray-scale data during a period until the next horizontal scanning period starts after the eighth data enable signal $EIO_8$ has been output, whereby power consumption can be reduced.

2.2 Second Embodiment

The first embodiment illustrates the case where mask control is performed for the gray-scale data supplied to each SR block. However, the present invention is not limited thereto. In the second embodiment, mask control is performed for the gray-scale data and the clock signal supplied to each SR block.

Figure 16:
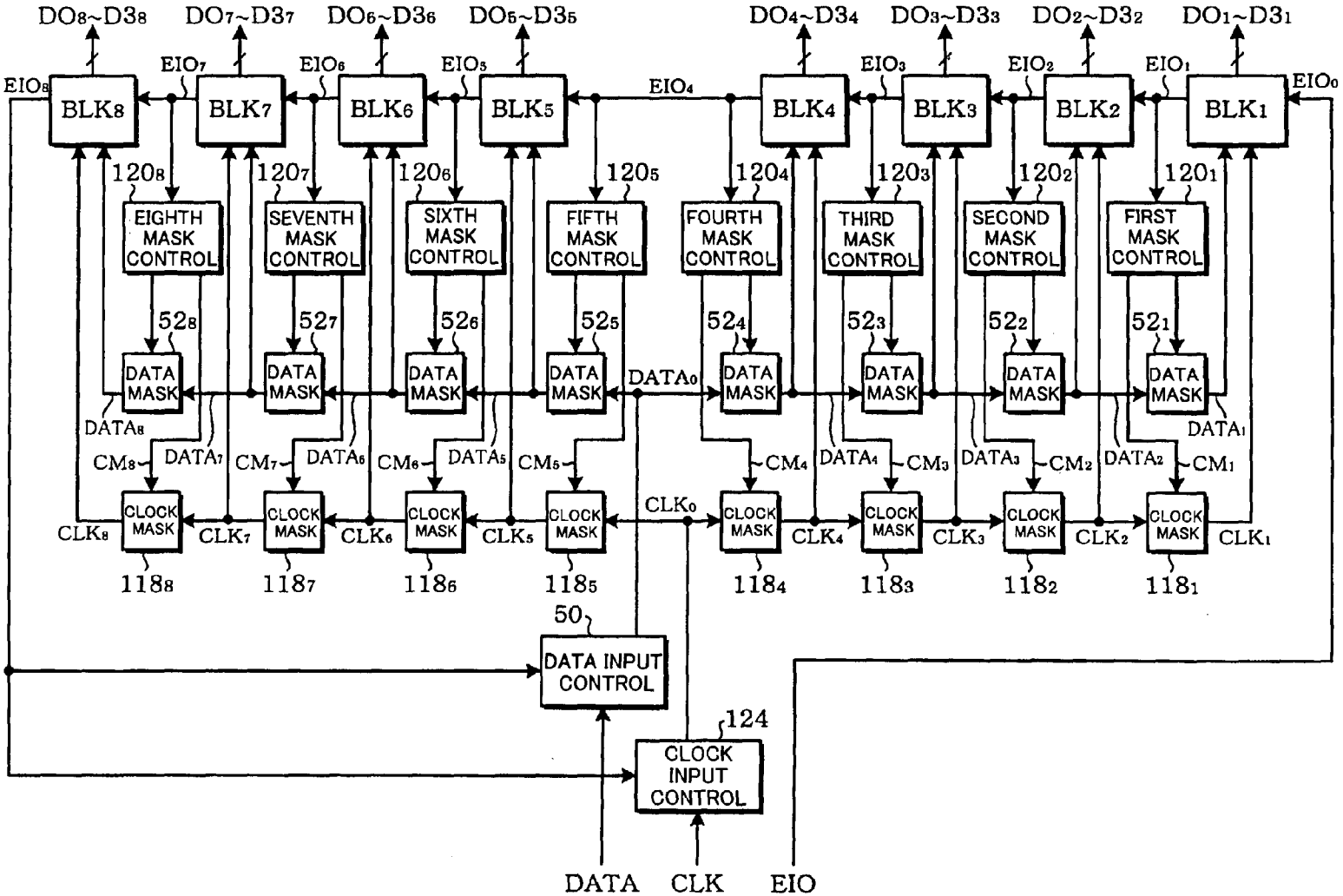
FIG. 16 is a block diagram showing an outline of a configuration of a shift register section of a display driver circuit in a second embodiment.

FIG. 16 shows an outline of a configuration of a shift register section of a display driver circuit in the second embodiment.

In FIG. 16, sections the same as those of the shift register section of the display driver circuit in the first embodiment shown in FIG. 6 are indicated by the same symbols. Description of these sections is appropriately omitted. The display driver circuit in the second embodiment may be applied to the signal driver shown in FIG. 3. In this case, the shift register section shown in FIG. 16 corresponds to the shift register section 40 shown in FIG. 3.

In FIG. 16, first to eighth clock mask control circuits $\mathbf{118}_1$ to $\mathbf{118}_8$ are provided corresponding to the first to eighth data mask circuits $\mathbf{52}_1$ to $\mathbf{52}_8$. First to eighth mask control circuits $\mathbf{120}_1$ to $\mathbf{120}_8$ are provided corresponding to the first to eighth data mask circuits $\mathbf{52}_1$ to $\mathbf{52}_8$.

The first to eighth mask control circuits $\mathbf{120}_1$ to $\mathbf{120}_8$ have the same function as the first to eighth data mask control circuits $\mathbf{54}_1$ to $\mathbf{54}_8$ in the first embodiment, and are capable of generating first to eighth clock mask control signals $CM_1$ to $CM_8$. The first to eighth clock mask circuits $\mathbf{118}_1$ to $\mathbf{118}_8$ perform mask control based on the first to eighth clock mask control signals $CM_1$ to $CM_8$ and output the first to eighth clock signals $CLK_1$ to $CLK_8$.

The first to eighth clock mask circuits $\mathbf{118}_1$ to $\mathbf{118}_8$ differ in the mask control method and the generation method of the clock mask control signal depending on whether the first to eighth clock mask circuits $\mathbf{118}_1$ to $\mathbf{118}_8$ are disposed on either the right side or the left side of a clock input control circuit 124 in the same manner as shown in FIG. 6. Therefore, mask control for the clock signal CLK can be controlled by dividing the mask control into the first system and the second system in the same manner as shown in FIGS. 7 and 8.

2.2.1 First System

Figure 17:
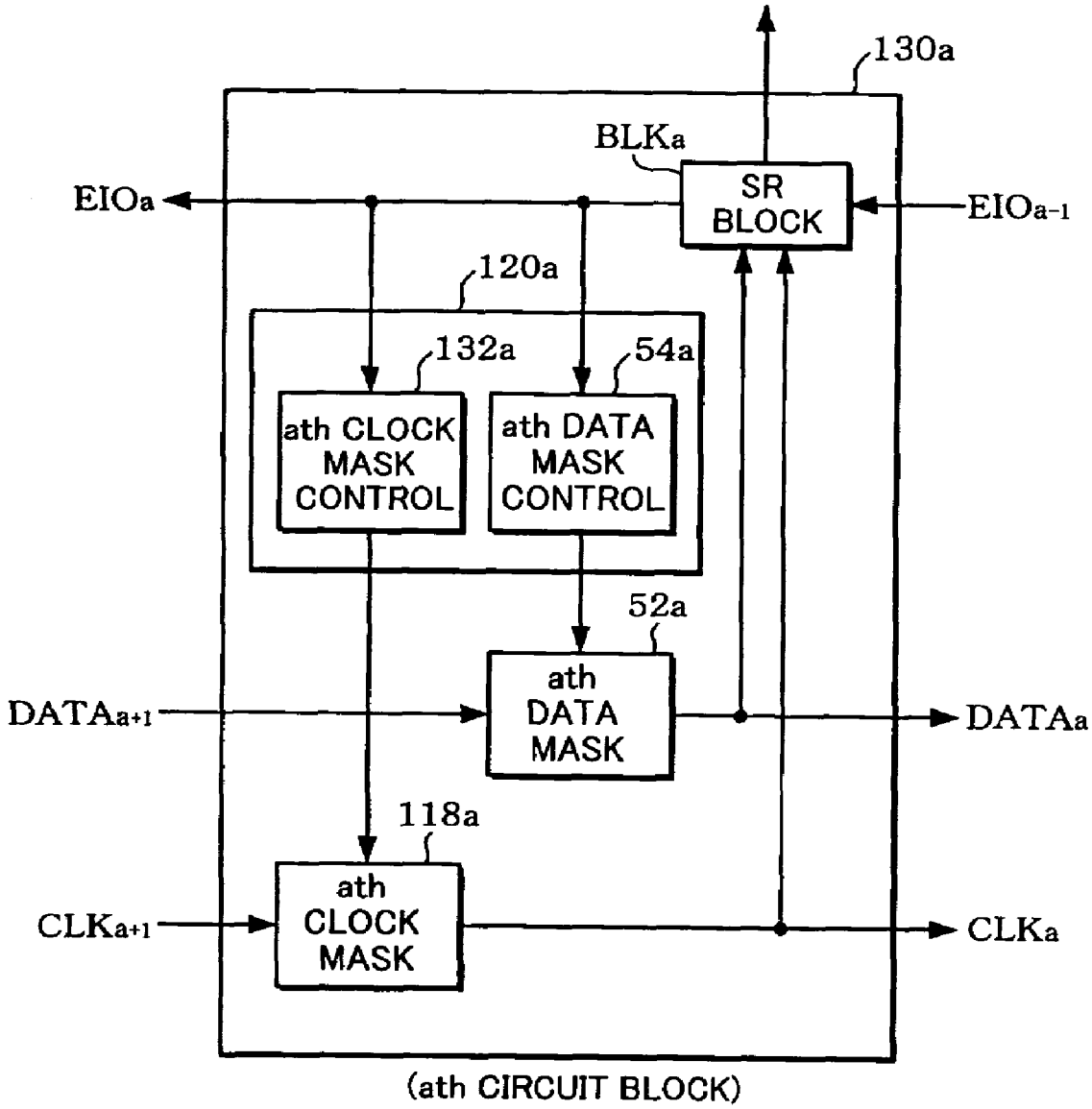
FIG. 17 is a block diagram showing an outline of a configuration of a circuit block in a first system in the second embodiment.

FIG. 17 shows an outline of a configuration of a circuit block in the first system in the second embodiment.

In FIG. 17, sections the same as those of the circuit block $\mathbf{60}_a$ ($1 \leqq a \leqq M$ (=4); a is an integer) in the first system shown in FIG. 7 are indicated by the same symbols. Description of these sections is appropriately omitted.

A circuit block $\mathbf{130}_a$ in the first system in the second embodiment differs from the circuit block $\mathbf{60}_a$ in the first system in the first embodiment in that the circuit block $\mathbf{130}_a$ includes an ath clock mask control circuit $\mathbf{132}_a$ and an ath clock mask circuit $\mathbf{118}_a$.

The ath clock mask control circuit $\mathbf{132}_a$ generates the ath clock mask control signal $CM_a$ based on the data enable signal $EIO_a$ (ath data enable signal) output from the SR block $BLK_a$.

The ath clock mask circuit $\mathbf{118}_a$ performs mask control for the (a+1)th clock signal $CLK_{a+1}$ by using the ath clock mask control signal $CM_a$, and generates the ath clock signal $CLK_a$.

2.2.2 Second System

Figure 18:
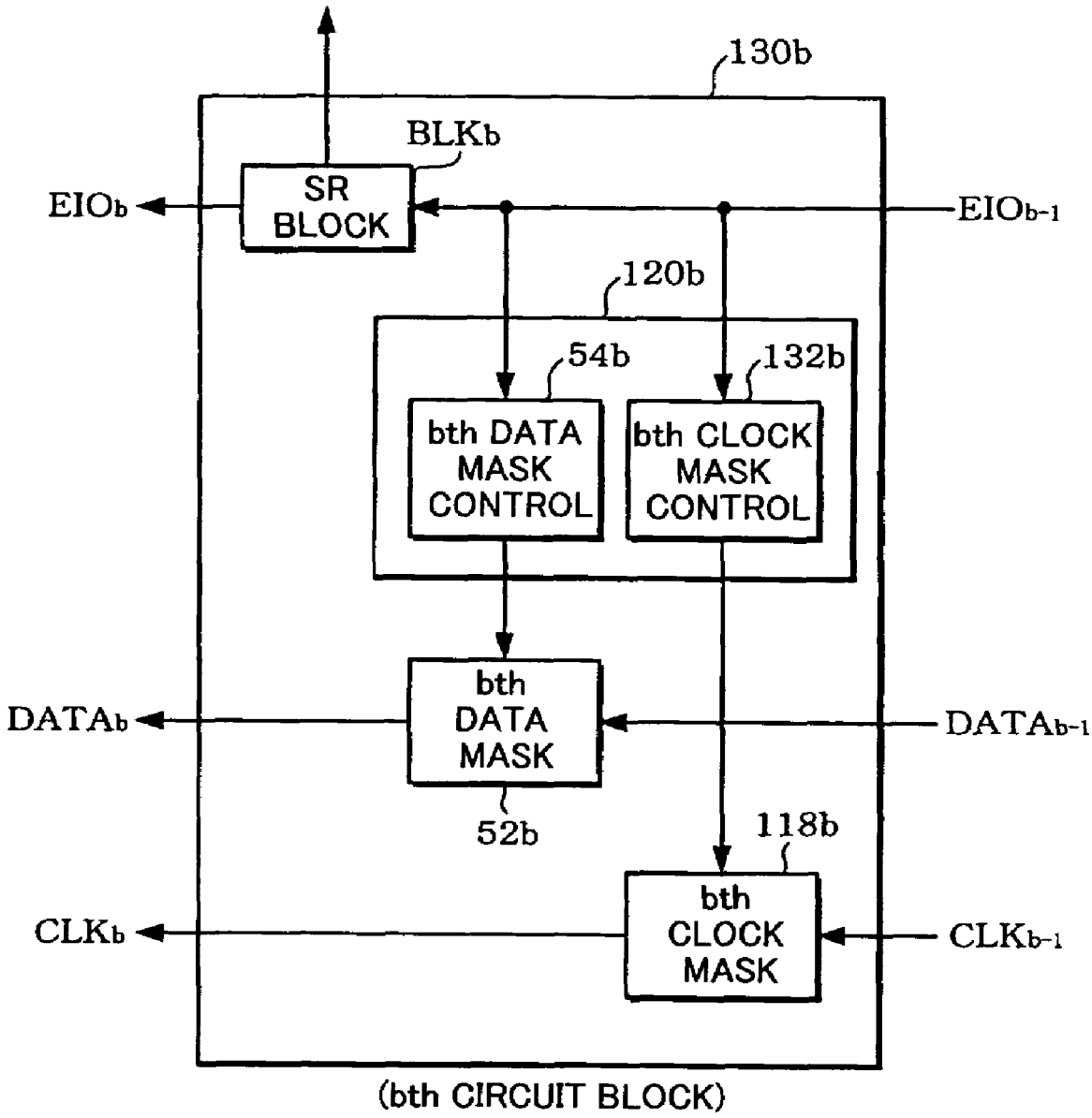
FIG. 18 is a block diagram showing an outline of a configuration of a circuit block in a second system in the second embodiment.

FIG. 18 shows an outline of a configuration of a circuit block in the second system in the second embodiment.

In FIG. 18, sections the same as those of the circuit block $\mathbf{60}_b$ ($M+1$ (=5) $\leqq b \leqq M+N$ (=8); b is an integer) in the second system shown in FIG. 8 are indicated by the same symbols. Description of these sections is appropriately omitted.

A circuit block $\mathbf{130}_b$ in the second system in the second embodiment differs from the circuit block $\mathbf{60}_b$ in the second system in the first embodiment in that the circuit block $\mathbf{130}_b$ includes a bth clock mask control circuit $\mathbf{132}_b$ and a bth clock mask circuit $\mathbf{118}_b$.

The bth clock mask control circuit $\mathbf{132}_b$ generates the bth clock mask control signal $CM_b$ based on the data enable signal $EIO_{b-1}$ ((b−1)th data enable signal) output from the SR block $BLK_{b-1}$.

The bth clock mask circuit $\mathbf{118}_b$ performs mask control for the (b−1)th clock signal $CLK_{b-1}$ by using the bth clock mask control signal $CM_b$, and generates the bth clock signal $CLK_b$.

2.2.3 Timing Example

Figure 19:
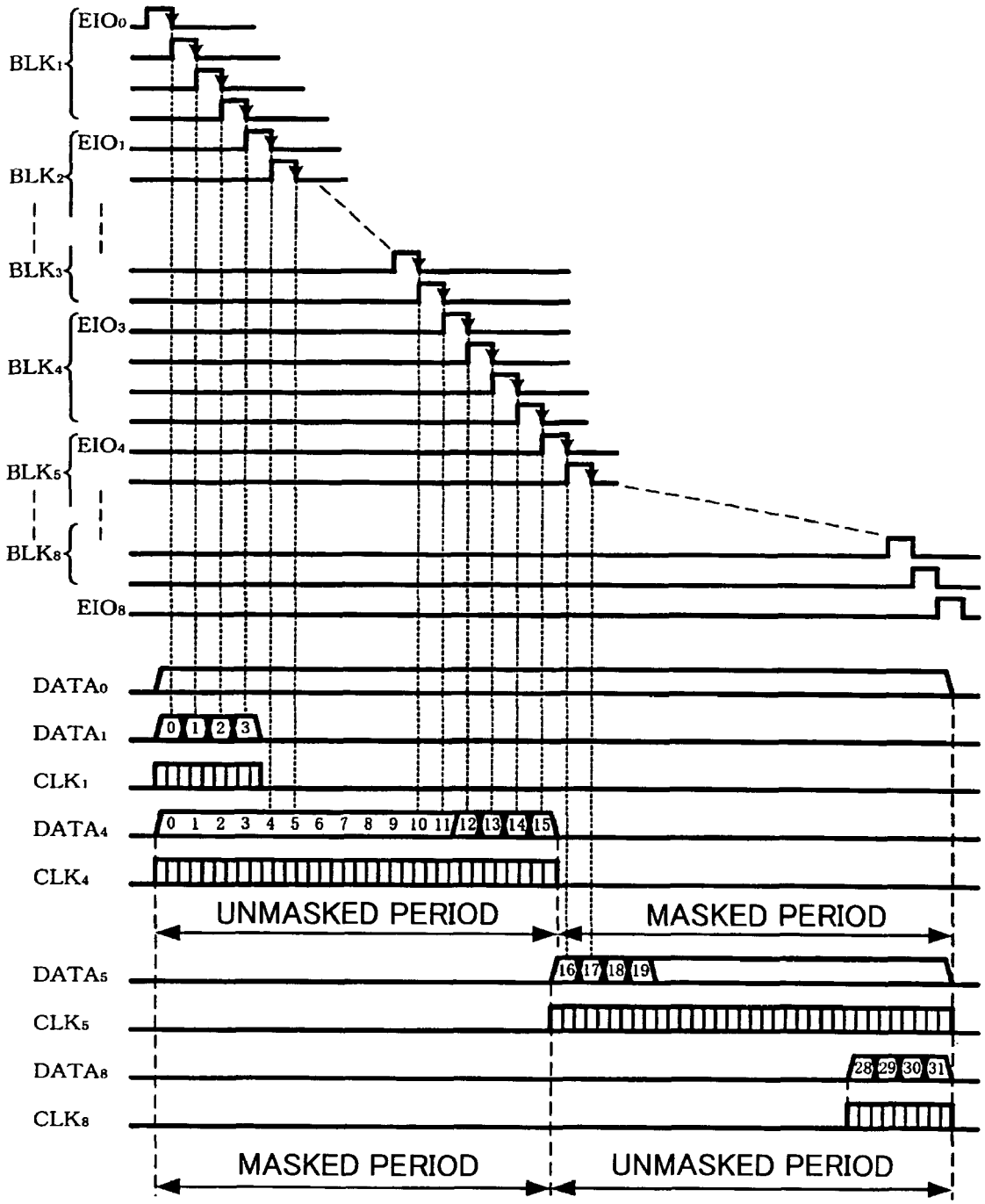
FIG. 19 is a timing chart showing an example of fetch timing of gray-scale data in the second embodiment.

FIG. 19 shows an example of fetch timing of the gray-scale data of the display driver circuit shown in FIG. 16.

Since the data mask control is the same as that shown in FIG. 9, only the clock mask control is described below.

The 0th to seventh data enable signals $EIO_0$ to $EIO_7$ are input to the SR blocks $BLK_1$ to $BLK_8$. Each of the SR blocks shifts the data enable signal input thereto and sequentially outputs the data enable signal to the adjacent SR block. Each of the SR blocks latches the gray-scale data input thereto at a falling edge of the shifted data enable signal.

The clock signal CLK which specifies the shift timing of the data enable signal is input to the clock input control circuit 124. The clock input control circuit 124 outputs the 0th clock signal $CLK_0$ to the fourth and fifth clock mask circuits $\mathbf{118}_4$ and $\mathbf{118}_5$ in a gray-scale data fetch period (period until the eighth data enable signal $EIO_8$ is output after the 0th data enable signal $EIO_0$ is input, for example).

Since the fourth clock mask circuit $\mathbf{118}_4$ is set to the unmasked state, the clock signal input to the fourth clock mask circuit $\mathbf{118}_4$ is output as is to the third clock mask circuit $\mathbf{118}_3$. The clock signal output through the second and first clock mask circuits $\mathbf{118}_2$ and $\mathbf{118}_1$ is output to the SR block $BLK_1$ as the first clock signal $CLK_1$. The SR block $BLK_1$ shifts the 0th data enable signal $EIO_0$ in synchronization with the first clock signal $CLK_1$ and fetches the gray-scale data.

Since the fifth clock mask circuit 118$_5$ is set to the masked state, the output of the fifth clock mask circuit 118$_5$ is fixed at a logic level "L". Therefore, the clock signal output from the clock input control circuit 124 is not supplied to the sixth, seventh, and eighth clock mask circuits 118$_6$, 118$_7$, and 118$_8$.

The clock signal corresponding to the SR block $BLK_2$ is output from the second clock mask circuit 118$_2$ in the same manner as described above. The first mask control circuit 120$_1$ generates the first clock mask control signal $CM_1$ based on the first data enable signal $EIO_1$ output from the SR block $BLK_1$ in addition to the first data mask control signal $DM_1$. The first clock mask circuit 118$_1$ fixes the output thereof at a logic level "L" by using the first clock mask control signal $CM_1$ at the next shift timing of the data enable signal.

The third and fourth clock mask circuits 118$_3$ and 118$_4$ sequentially fix the outputs thereof at a logic level "L" in the same manner as described above.

As a result, the first to fourth clock signals $CLK_1$ to $CLK_4$ in the first system are set as shown in FIG. 19.

The first clock signal $CLK_1$ is unmasked only in a period until the gray-scale data is fetched by the SR block $BLK_1$ and is then masked. The second clock signal $CLK_2$ is unmasked only in a period until the gray-scale data is fetched by the SR blocks $BLK_1$ and $BLK_2$ and is then masked. The third clock signal $CLK_3$ is unmasked only in a period until the gray-scale data is fetched by the SR blocks $BLK_1$ to $BLK_3$ and is then masked. The fourth clock signal $CLK_4$ is unmasked only in a period until the gray-scale data is fetched by the SR blocks $BLK_1$ to $BLK_4$ and is then masked.

When the fourth data enable signal $EIO_4$ is output from the SR block $BLK_4$, the output of the fifth clock mask circuit 118$_5$ is unmasked by using the fifth clock mask control signal $CM_5$ generated by the fifth mask control circuit 120$_5$. Therefore, the SR block $BLK_5$ latches the fifth gray-scale data $DATA_5$ by using the data enable signal shifted based on the fifth clock signal $CLK_5$ which is output when the output of the fifth clock mask circuit 118$_5$ is unmasked. The output of the sixth clock mask circuit 118$_6$ remains in the masked state at this stage.

When the fifth data enable signal $EIO_5$ is output from the SR block $BLK_5$, the output of the sixth clock mask circuit 118$_6$ is unmasked by using the sixth clock mask control signal $CM_6$ generated by the sixth mask control circuit 120$_6$. The SR block $BLK_6$ latches the sixth gray-scale data $DATA_6$ input from the clock input control circuit 124 through the fifth clock mask circuit 118$_5$ which remains in the unmasked state based on the sixth clock signal $CLK_6$. The output of the seventh clock mask circuit 118$_7$ remains in the masked state at this stage.

The SR blocks $BLK_7$ and $BLK_8$ sequentially latch the seventh and eighth gray-scale data $DATA_7$ and $DATA_8$ based on the seventh and eighth clock signals $CLK_7$ and $CLK_8$ in the same manner as described above.

As a result, the fifth to eighth clock signals $CLK_5$ to $CLK_8$ in the second system are set as shown in FIG. 19.

Specifically, the eighth clock signal $CLK_8$ is unmasked only in a period until the gray-scale data is fetched by the SR block $BLK_8$ and is then masked. The seventh clock signal $CLK_7$ is unmasked only in a period until the gray-scale data is fetched by the SR blocks $BLK_7$ and $BLK_8$ and is then masked. The sixth clock signal $CLK_6$ is unmasked only in a period until the gray-scale data is fetched by the SR blocks $BLK_6$ to $BLK_8$ and is then masked. The fifth clock signal $CLK_5$ is unmasked only in a period until the gray-scale data is fetched by the SR blocks $BLK_5$ to $BLK_8$ and is then masked.

2.2.4 Detailed Circuit Configuration Example

Figure 20:
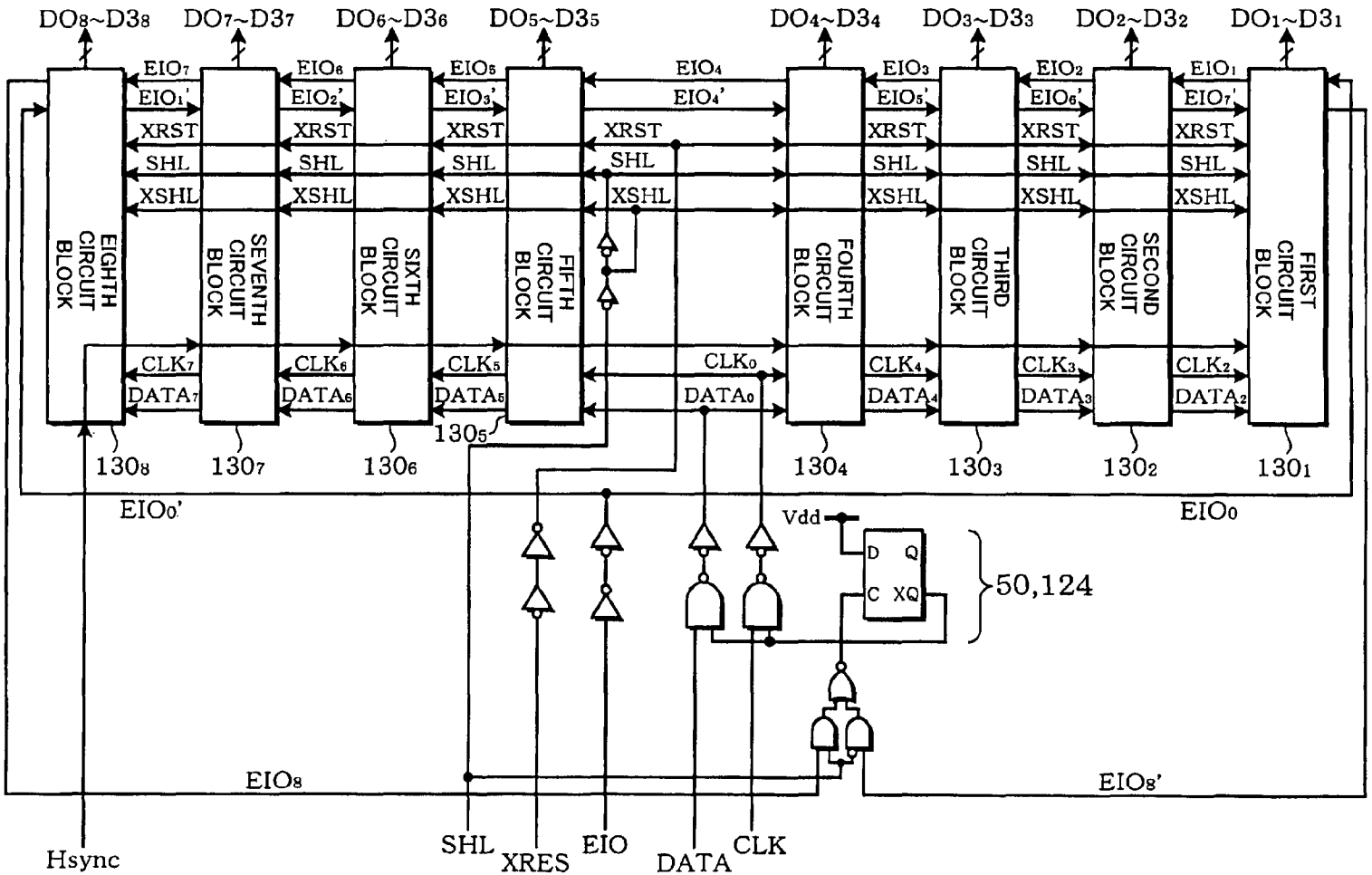
FIG. 20 is an entire block diagram of a detailed configuration example of a shift register section of a display driver circuit in the second embodiment.

FIG. 20 shows an entire block diagram of a detailed configuration example of the shift register section of the display driver circuit in the second embodiment.

In FIG. 20, sections the same as those of the shift register section 90 of the display driver circuit in the first embodiment shown in FIG. 11 are indicated by the same symbols. Description of these sections is appropriately omitted.

A shift register section 140 corresponds to the shift register section 40 shown in FIG. 3. The shift register section 140 includes first to fourth circuit blocks 130$_1$ to 130$_4$ in the first system having the configuration shown in FIG. 17, and fifth to eighth circuit blocks 130$_5$ to 130$_8$ in the second system having the configuration shown in FIG. 18.

The clock input control circuit 124 controls the input of the clock signal CLK by using a signal output from an inverted output terminal XQ of a flip-flop which is connected with the power supply potential at a data terminal D.

Figure 21:
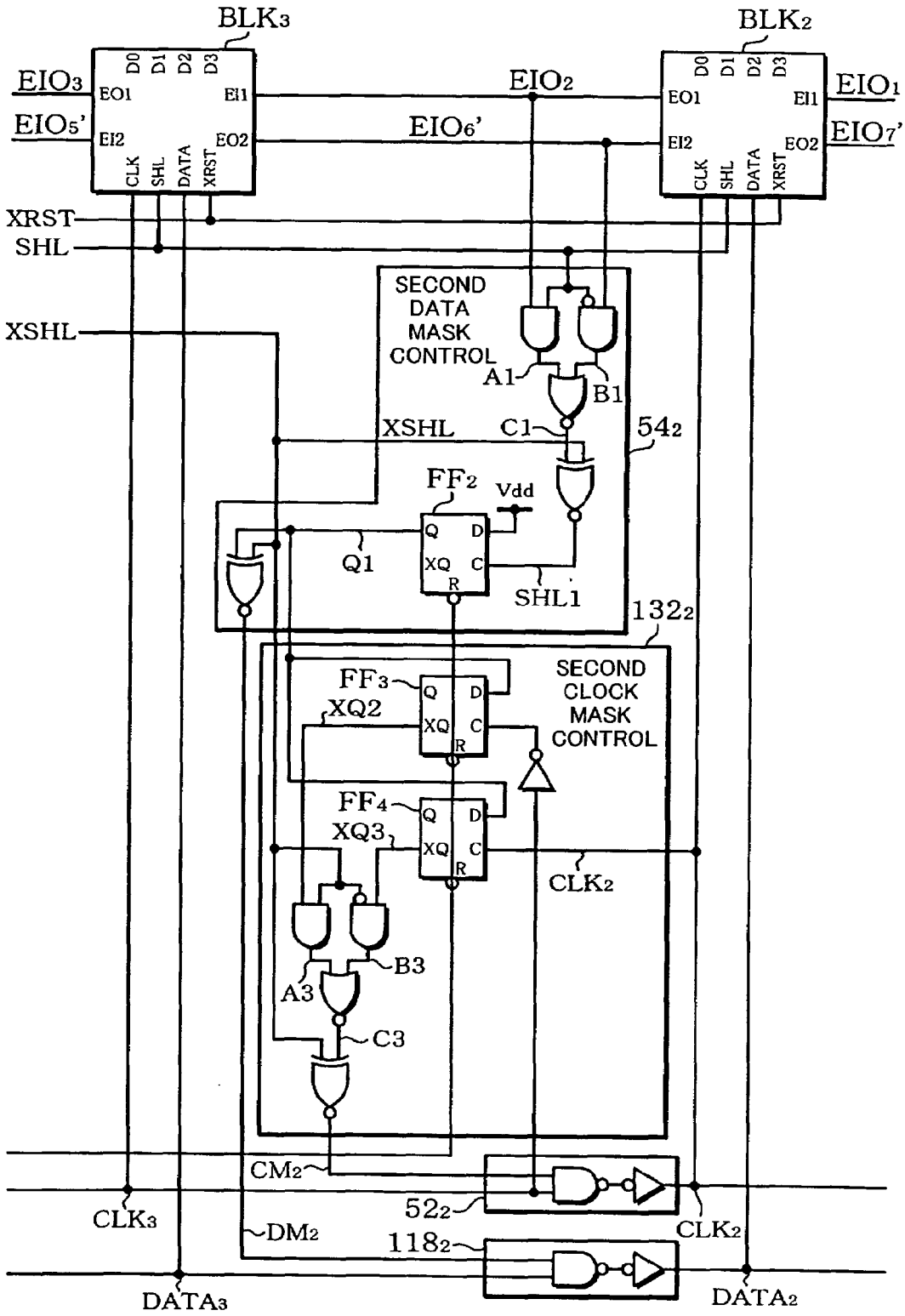
FIG. 21 is a circuit diagram showing a configuration example of a data mask control circuit, data mask circuit, clock mask control circuit, and clock mask circuit.

FIG. 21 shows a circuit configuration example of the data mask control circuit, the data mask circuit, the clock control circuit, and the clock mask circuit.

FIG. 21 shows a configuration example of the second data mask control circuit 54$_2$, the second data mask circuit 52$_2$, the second clock mask control circuit 132$_2$, and the second clock mask circuit 118$_2$ in the first system. The second mask control circuit 120$_2$ includes the second data mask control circuit 54$_2$ and the second clock mask control circuit 132$_2$. Since the second data mask control circuit 54$_2$ and the second data mask circuit 52$_2$ are the same as those shown in FIG. 13, description of these circuits is omitted.

The second clock mask control circuit 132$_2$ generates the second clock mask control signal $CM_2$ by using the output of the Q terminal of the flip-flop $FF_2$ of the second data mask control circuit 54$_2$. The second clock mask control circuit 132$_2$ includes flip-flops $FF_3$ and $FF_4$. The Q terminal of the flip-flop $FF_2$ is connected with D terminals of the flip-flops $FF_3$ and $FF_4$. An inverted signal of the third clock signal $CLK_3$ is input to a C terminal of the flip-flop $FF_3$. The second clock signal $CLK_2$ is input to a C terminal of the flip-flop $FF_4$. This enables the data mask timing to be shifted from the clock mask timing for a half-period, whereby the clock mask control can be performed by using a hazard-free clock mask control signal. This prevents occurrence of a problem in which the data enable signal is shifted due to occurrence of a hazard.

Figure 22:
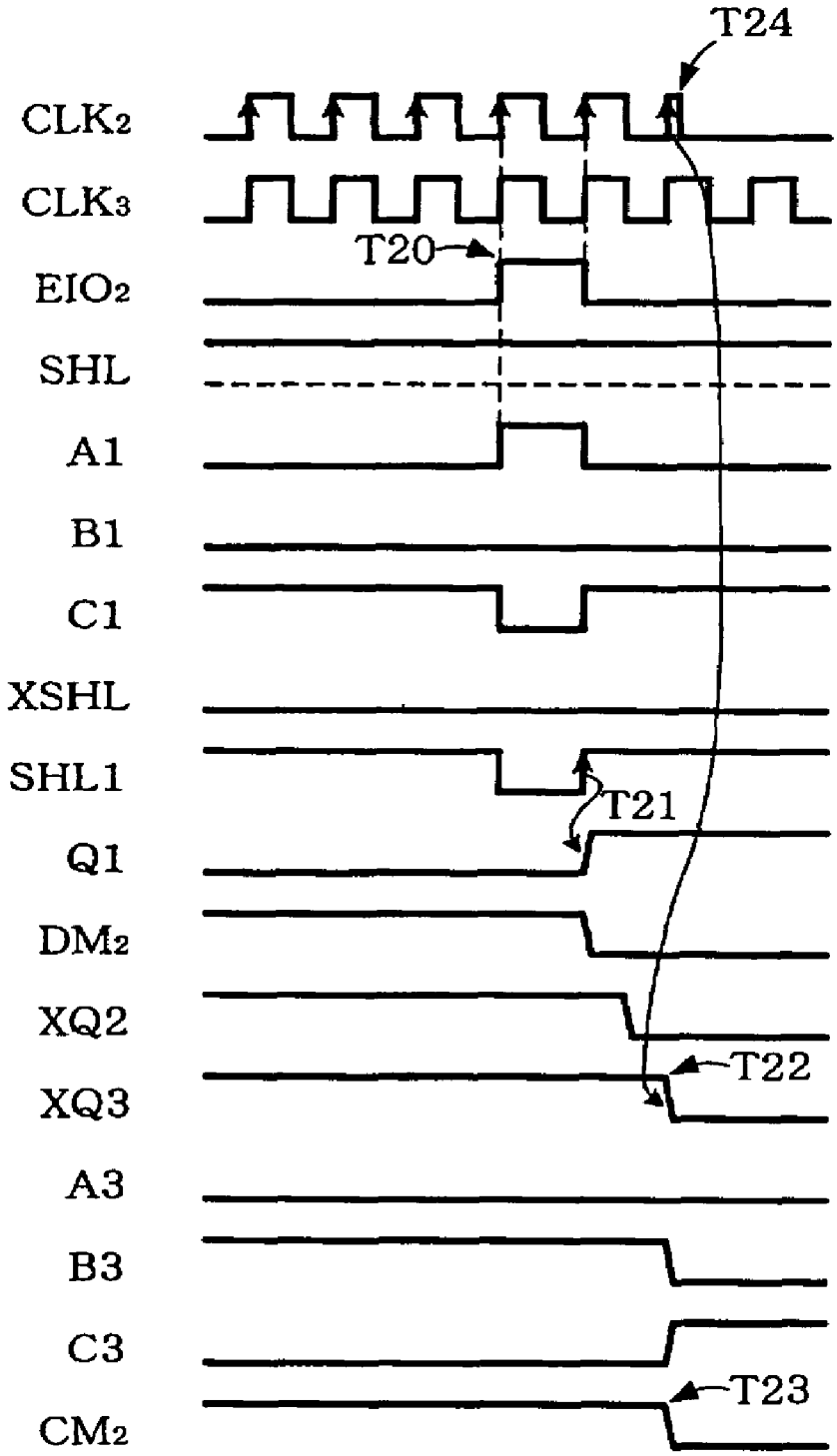
FIG. 22 is a timing chart showing an example of operation timing of a data mask control circuit, data mask circuit, clock mask control circuit, and clock mask circuit.

FIG. 22 shows an example of clock mask operation timing of the circuits shown in FIG. 21.

The following description illustrates the case where the shift signal SHL is fixed at a logic level "H". In the case where the left direction is the second direction, the data enable signal is shifted to the left direction (second direction) when the shift signal SHL is at a logic level "H" (second level).

The third clock signal $CLK_3$ is input to the second clock mask circuit 118$_2$ which is in the unmasked state. Therefore, the second clock mask circuit 118$_2$ outputs the third clock signal $CLK_3$ input thereto as the second clock signal $CLK_2$.

When the second data enable signal $EIO_2$ is output from the SR block $BLK_2$ (T20), the Q terminal of the flip-flop $FF_2$ is set at a logic level "H" in the second data mask control circuit 54$_2$ (T21). This allows the second data mask control signal $DM_2$ to be set at a logic level "L", whereby the second gray-scale data $DATA_2$ is masked.

In the second clock mask control circuit 132$_2$, an XQ2 signal output from the flip-flop $FF_3$ is set at a logic level "L" in synchronization with a falling edge of the third clock signal $CLK_3$. An XQ3 signal output from the flip-flop $FF_4$ is set at a logic level "L" in synchronization with a rising edge of the second clock signal $CLK_2$ (T22). Since the inverted shift signal XSHL is fixed at a logic level "L", the second clock mask control signal $CM_2$ is set at a logic level "L" (T23). This allows the second clock signal $CLK_2$ to be masked by using the second clock mask control signal $CM_2$ (T24).

The second clock signal $CLK_2$ is in the shape of a short pulse. However, malfunction of the circuit does not occur since the second data enable signal $EIO_2$ has been output.

Figure 23:
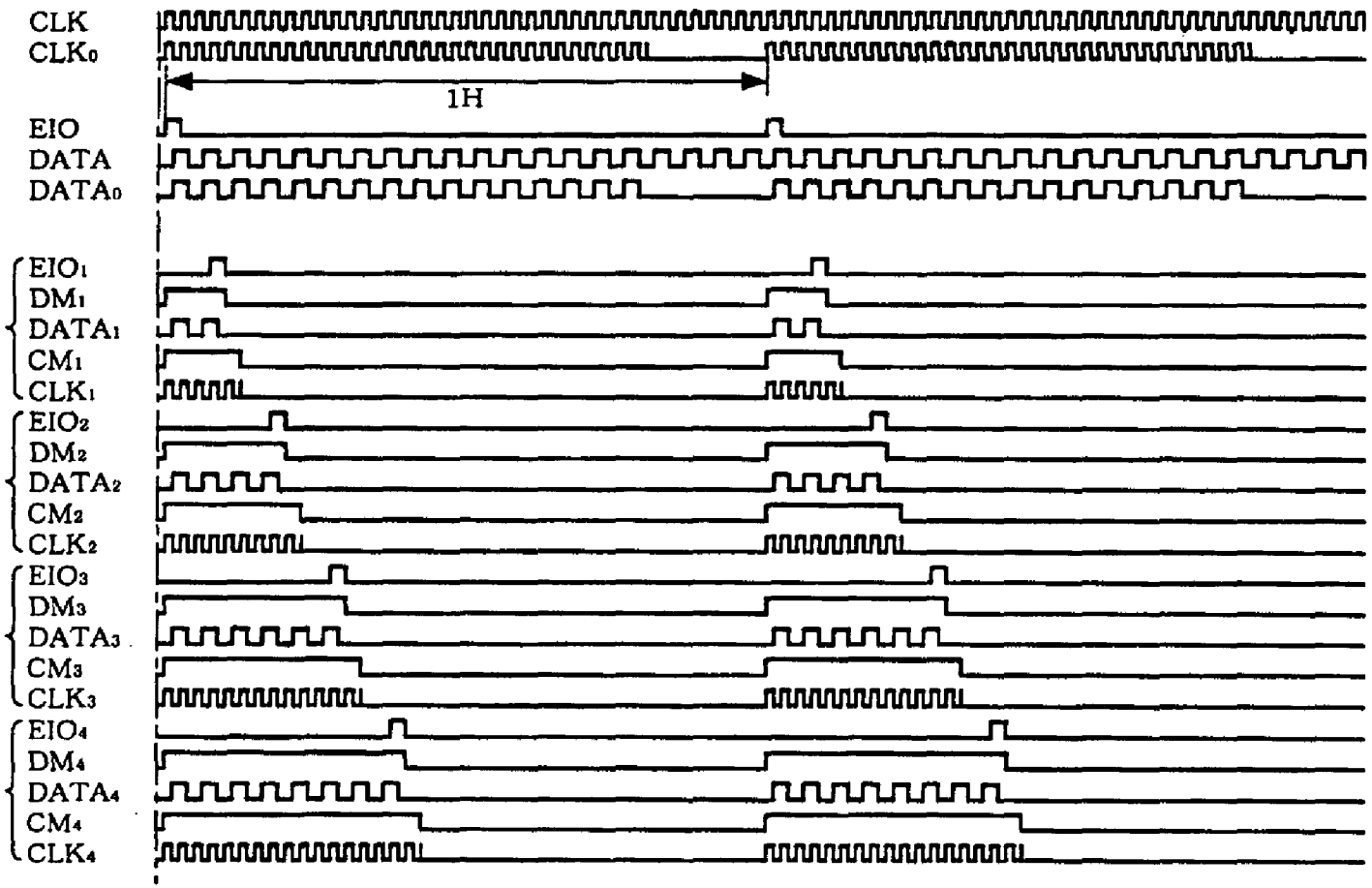
FIG. 23 is a timing chart showing an example of operation timing of a circuit block in a first system in the second embodiment.

FIG. 23 shows an example of operation timing of the circuit block in the first system.

Since the mask control for the gray-scale data is the same as that shown in FIG. 14, only the mask control for the clock signal is described below.

The data enable signal EIO is shifted in the direction from the first circuit block 130$_1$ to the fourth circuit block 130$_4$ as the 0th data enable signal $EIO_0$. Therefore, the first clock mask circuit 118$_1$ unmasks the first clock signal $CLK_1$ until the first data enable signal $EIO_1$ is output, and masks the first clock signal $CLK_1$ when the first data enable signal $EIO_1$ is output.

The second clock mask circuit 118$_2$ of the second circuit block 130$_2$ unmasks the second clock signal $CLK_2$ until the second data enable signal $EIO_2$ is output, and masks the second clock signal $CLK_2$ when the second data enable signal $EIO_2$ is output.

The above mask control is also performed in the third and fourth circuit blocks 130$_3$ and 130$_4$. As described above, the first to fourth clock mask circuits 118$_1$ to 118$_4$ unmask the first to fourth clock signals $CLK_1$ to $CLK_4$ until the first to fourth data enable signals $EIO_1$ to $EIO_4$ are output, and mask the first to fourth clock signals $CLK_1$ to $CLK_4$ when the first to fourth data enable signals $EIO_1$ to $EIO_4$ are output. Therefore, since it suffices to drive the clock signal only at the timing necessary for supplying the gray-scale data, unnecessary power consumption can be significantly reduced.

Figure 24:
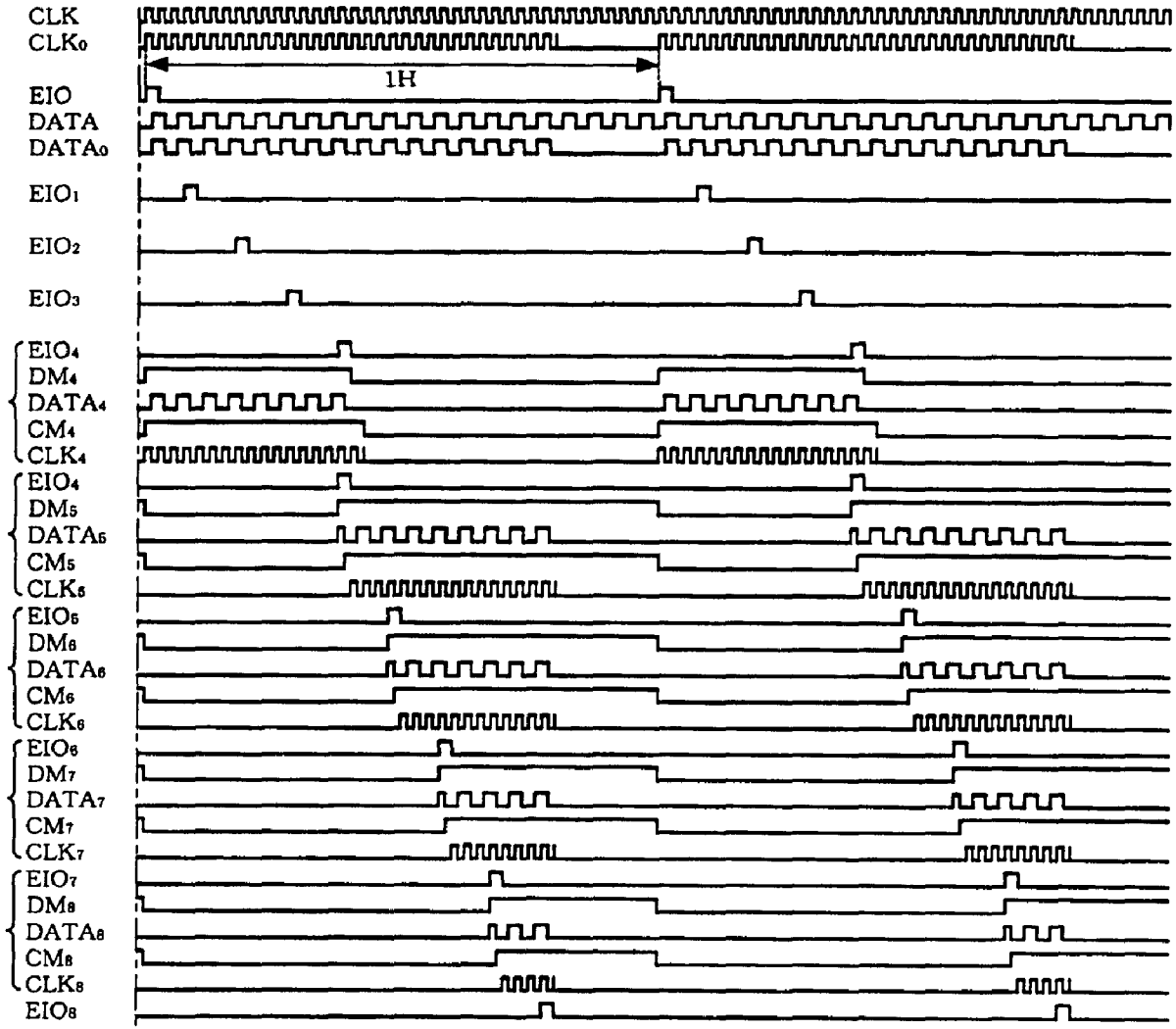
FIG. 24 is a timing chart showing an example of operation timing of a circuit block in a second system in the second embodiment.

FIG. 24 shows an example of operation timing of the second system.

The following description illustrates the case where the fifth to eighth circuit blocks 130$_5$ to 130$_8$ shift the fourth data enable signal $EIO_4$ output from the fourth circuit block 130$_4$ in the direction from the fifth circuit block 130$_5$ to the eighth circuit block 130$_8$.

The fifth clock mask circuit 118$_5$ unmasks the 0th clock signal $CLK_0$ after the fourth data enable signal $EIO_4$ is output and then outputs the fifth clock signal $CLK_5$. The unmasked state is maintained until at least the eighth data enable signal $EIO_8$ is output (until one horizontal scanning period ends in FIG. 24).

The sixth clock mask circuit 118$_6$ of the sixth circuit block 130$_6$ unmasks the fifth clock signal $CLK_5$ after the fifth data enable signal $EIO_5$ is output and then outputs the sixth clock signal $CLK_6$. The unmasked state is maintained until at least the eighth data enable signal $EIO_8$ is output (until one horizontal scanning period ends in FIG. 24).

The above mask control is also performed in the seventh and eighth circuit blocks 130$_7$ and 130$_8$. As described above, the fifth to eighth clock mask circuits 118$_5$ to 118$_8$ unmask the 0th clock signal $CLK_0$ and the fifth to seventh clock signals $CLK_5$ to $CLK_7$ after the fourth to seventh data enable signals $EIO_4$ to $EIO_7$ are output and then output the fifth to eighth clock signals $CLK_5$ to $CLK_8$. The unmasked state is maintained until at least the eighth data enable signal $EIO_8$ is output (until one horizontal scanning period ends in FIG. 24). Therefore, since it suffices to drive the clock signal only at the timing necessary for supplying the gray-scale data, unnecessary power consumption can be significantly reduced.

Moreover, it is unnecessary for the clock input control circuit 124 to drive the clock signal through the entire horizontal scanning period (1H). Specifically, it is unnecessary to drive the clock signal during a period until the next horizontal scanning period starts after the eighth data enable signal $EIO_8$ has been output, whereby power consumption can be reduced.

The present invention is not limited to the above-described embodiment. Various modifications and variations are possible within the spirit and scope of the present invention.

The above embodiments illustrate the case where M and N are four. However, M and N may be either more than four or less than four. M may be either greater than or less than N.

Figure 25:
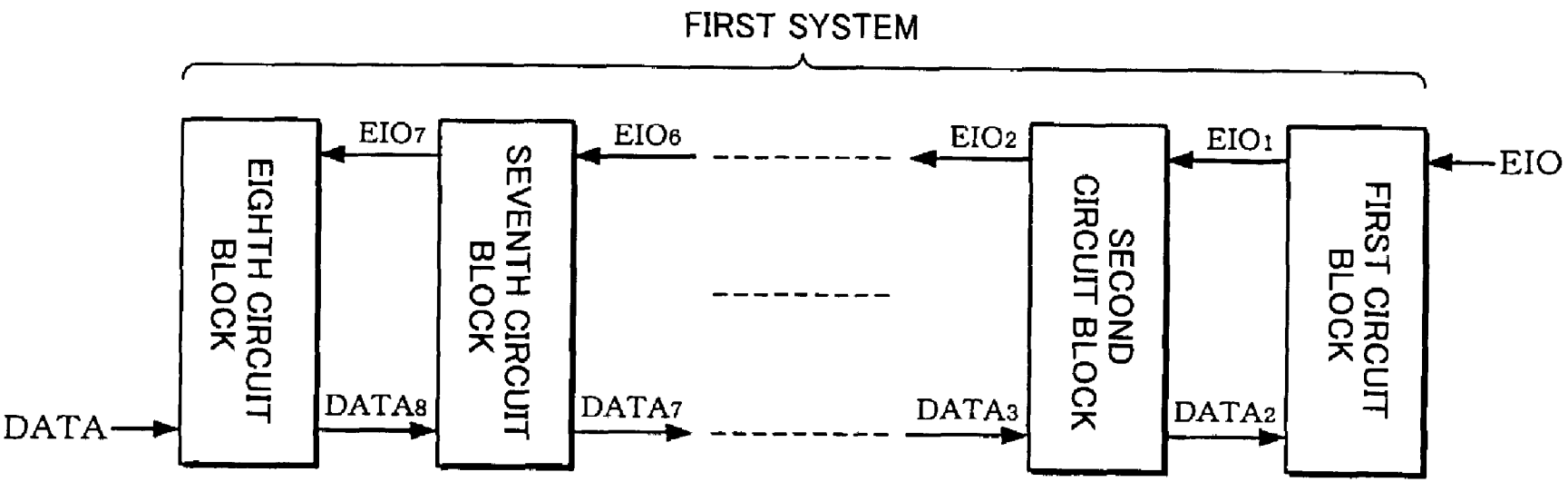
FIG. 25 is a configuration diagram showing an outline of a display driver circuit formed by using only circuit blocks in a first system.
Figure 26:
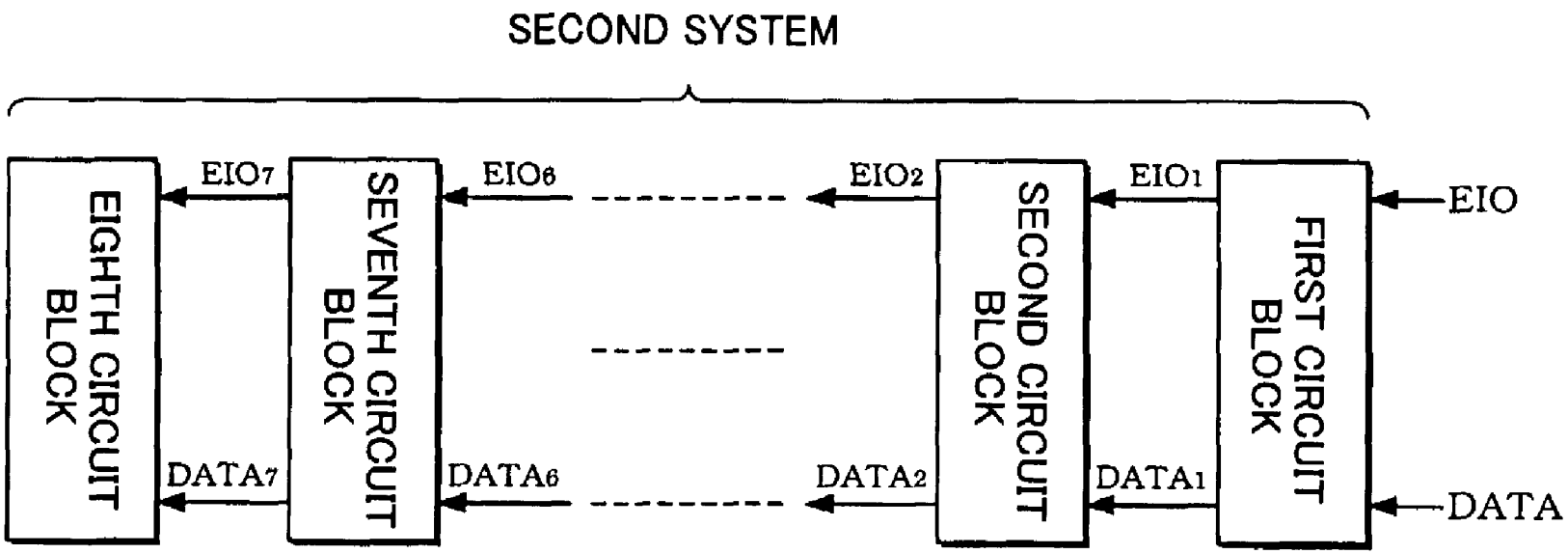
FIG. 26 is a configuration diagram showing an outline of a display driver circuit formed by using only circuit blocks in a second system.

Unnecessary power consumption can be reduced even in the case where the display driver circuit is formed by using only the circuit blocks in the first system, as shown in FIG. 25. This also applies to the case where the display driver circuit is formed by using only the circuit blocks in the second system, as shown in FIG. 26. In FIG. 25, the display driver circuit can be easily formed by using the circuit blocks shown in FIG. 7 or 17. In FIG. 26, the display driver circuit can be easily formed by using the circuit blocks shown in FIG. 8 or 18.

Figure 27:
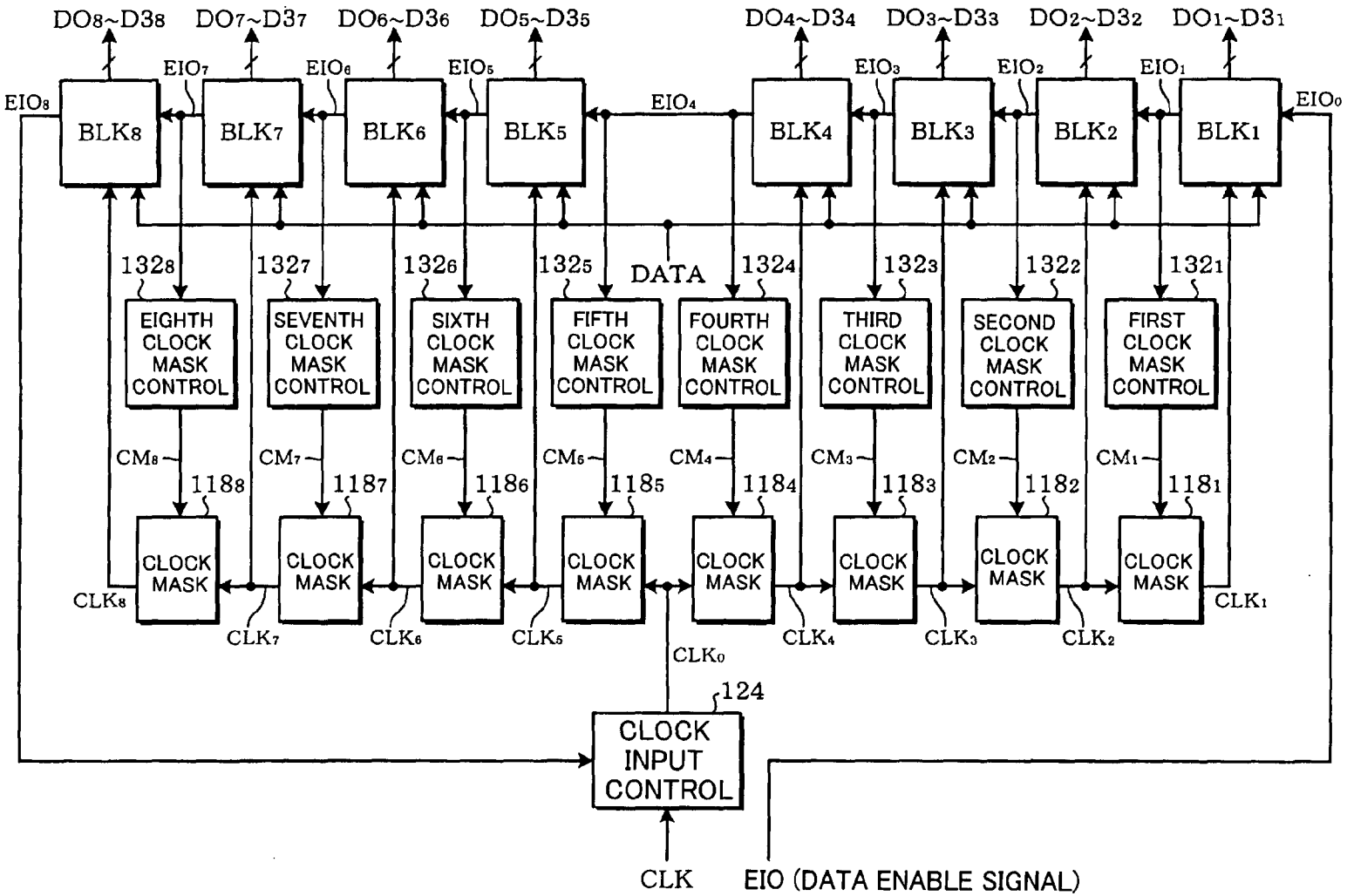
FIG. 27 is a diagram showing a configuration example of a display driver circuit which performs mask control only for a clock signal supplied to each SR block.
Figure 28A:
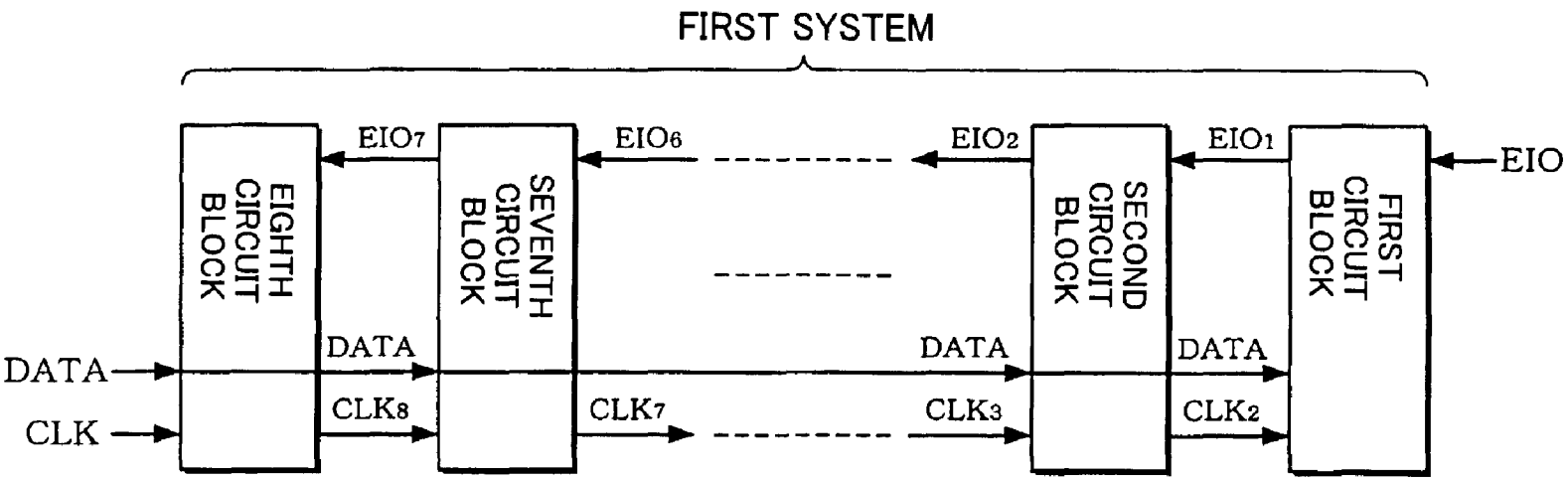
FIG. 28A is a configuration diagram showing an outline of a display driver circuit in which clock mask control is performed by using only circuit blocks in a first system.
Figure 28B:
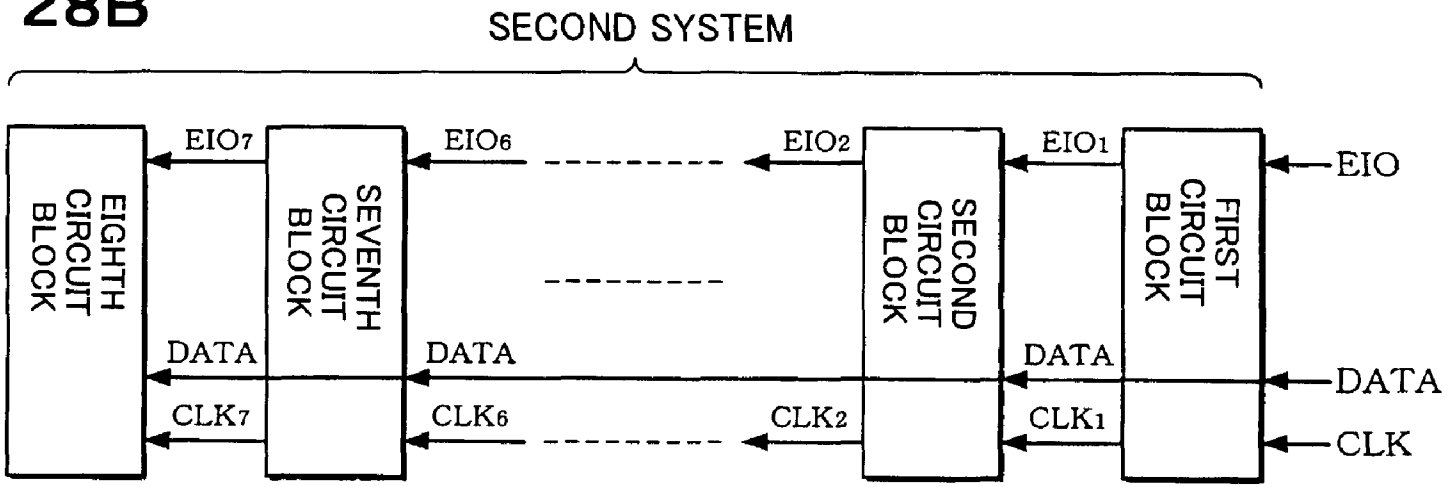
FIG. 28B is a configuration diagram showing an outline of a display driver circuit in which clock mask control is performed by using only circuit blocks in a second system.

As shown in FIG. 27, only the mask control for the clock signal supplied to each SR block may be performed without performing the mask control for the gray-scale data. As shown in FIG. 28A, only the mask control for the clock signal may be performed by using only the circuit blocks in the first system by applying the circuit blocks shown in FIG. 17. As shown in FIG. 28B, only the mask control for the clock signal may be performed by using only the circuit blocks in the second system by applying the circuit blocks shown in FIG. 18.

The above embodiments illustrate the case of driving a TFT liquid crystal device. However, the present invention may be applied to a simple matrix liquid crystal device, an organic EL panel including organic EL elements, and a plasma display device.

The specification discloses the following matters about the configuration of the embodiments described above.

According to one embodiment of the present invention, there is provided a display driver circuit which drives signal electrodes of a display device based on gray-scale data, comprising:

first to (M+N)th (M and N are positive integers) shift register blocks;

a data input control circuit which controls input of the gray-scale data supplied to the first to (M+N)th shift register blocks;

first to (M+N)th data mask circuits which generate first to (M+N)th gray-scale data by performing mask control for the gray-scale data supplied to the first to (M+N)th shift register blocks and output the first to (M+N)th gray-scale data; and a signal electrode driver circuit which drives the signal electrodes by using drive voltages corresponding to the first to (M+N)th gray-scale data, the first to (M+N)th gray-scale data being held in the first to (M+N)th shift register blocks, wherein the first to Mth shift register blocks are disposed in a region on a first direction side of the data input control circuit, shift a given data enable signal input to the first shift register block and output the shifted data enable signal to a shift register block adjacent in a second direction opposite to the first direction, and hold the first to Mth gray-scale data based on the shifted data enable signal, wherein the (M+1)th to (M+N)th shift register blocks are disposed in a region on the second direction side of the data input control circuit, shift a data enable signal input to the (M+1)th shift register block from the Mth shift register block and output the shifted data enable signal to a shift register block adjacent in the second direction, and hold the (M+1)th to (M+N)th gray-scale data based on the shifted data enable signal, wherein the first to Mth data mask circuits are connected in the second direction in order from the first to Mth data mask circuit and mask the first to Mth gray-scale data in order from the first to Mth data mask circuit, and wherein the (M+1)th to (M+N)th data mask circuits are connected in the second direction in order from the (M+1)th to (M+N)th data mask circuit and unmask the (M+1)th to (M+N)th gray-scale data in order from the (M+1)th to (M+N)th data mask circuit.

In this display driver circuit, the gray-scale data of which input is controlled by the data input control circuit are fetched in the shift register blocks.

In this case, the first to Mth shift register blocks hold the first to Mth gray-scale data based on a data enable signal to be shifted in the second direction while allowing the first to Mth data mask circuits connected in the second direction in the region on the first direction side of the data input control circuit to mask the first to Mth gray-scale data in order from the first to Mth data mask circuit. This prevents unnecessary driving of the gray-scale data for a shift register block which has fetched the gray-scale data. Specifically, since it suffices to drive a bus to which the gray-scale data is supplied only at the timing necessary for supplying the gray-scale data, unnecessary power consumption can be significantly reduced.

The (M+1)th to (M+N)th shift register blocks hold the (M+1)th to (M+N)th gray-scale data based on a data enable signal to be shifted in the second direction by allowing the (M+1)th to (M+N)th data mask circuits connected in the second direction in the region on the second direction side of the data input control circuit to unmask the (M+1)th to (M+N)th gray-scale data in order from the (M+1)th to (M+N)th data mask circuit. This makes it possible to sequentially drive the gray-scale data only for a shift register block which has not fetched the gray-scale data. Specifically, since it suffices to drive a bus to which the gray-scale data is supplied only at the timing necessary for supplying the gray-scale data, unnecessary power consumption can be significantly reduced.

This display driver circuit may further comprise first to (M+N)th data mask control circuits which generate first to (M+N)th data mask control signals for performing mask control for the first to (M+N)th gray-scale data, an ath ($1 \leqq a \leqq M$; a is an integer) data mask control circuit may generate an ath data mask control signal based on a data enable signal output from an ath shift register block, and a bth ($M+1 \leqq b \leqq M+N$; b is an integer) data mask control circuit may generate a bth data mask control signal based on a data enable signal output from a (b−1)th shift register block.

According to this display driver circuit, since the data mask control signals can be generated by using a data enable signal which is sequentially shifted, a display driver circuit capable of reducing unnecessary power consumption can be realized with a simple circuit configuration.

In this display driver circuit, a cth ($1 \leqq c \leqq M+N$; c is an integer) shift register block may shift a data enable signal in the first direction and may hold a cth gray-scale data based on the data enable signal shifted in the first direction, when a given shift signal is at a first level, the cth shift register block may shift a data enable signal in the second direction and may hold the cth gray-scale data based on the data enable signal shifted in the second direction, when the shift signal is at a second level, and a cth data mask control circuit may generate a cth data mask control signal according to the level of the shift signal.

According to this display driver circuit, a display driver circuit which is capable of controlling the shift direction so that an optimum interconnect length can be obtained according to the mounting state and capable of reducing unnecessary power consumption can be provided.

This display driver circuit may further comprise:

a clock input control circuit which controls input of a clock signal which is supplied to each of the first to (M+N)th shift register blocks and determines shift timing of a data enable signal; and first to (M+N)th clock mask circuits which generate first to (M+N)th clock signals by performing mask control for the clock signal supplied to the first to (M+N)th shift register blocks and output the first to (M+N)th clock signals, wherein the first to Mth shift register blocks are disposed in the region on the first direction side of the clock input control circuit and shift a data enable signal based on the first to Mth clock signals, wherein the (M+1)th to (M+N)th shift register blocks are disposed in the region on the second direction side of the clock input control circuit and shift a data enable signal based on the (M+1)th to (M+N)th clock signals, wherein the first to Mth clock mask circuits are connected in the second direction in order from the first to Mth clock mask circuit and mask the first to Mth clock signals in order from the first to Mth clock mask circuit, and wherein the (M+1)th to (M+N)th clock mask circuits are connected in the second direction in order from the (M+1)th to (M+N)th clock mask circuit and unmask the (M+1)th to (M+N)th clock signals in order from the (M+1)th to (M+N) th clock mask circuit.

According to this display driver circuit, mask control is performed for the clock signal which determines the shift timing of a data enable signal and is supplied to each of the shift register blocks in the same manner as the gray-scale data. Therefore, unnecessary power consumption of the display driver circuit when the gray-scale data is fetched can be significantly reduced.

This display driver circuit may further comprise first to (M+N)th clock mask control circuits which generate first to (M+N)th clock mask control signals for performing mask control for the first to (M+N)th clock signals, a dth ($1 \leqq d \leqq M$; d is an integer) clock mask control circuit may generate a dth clock mask control signal based on a data enable signal output from a dth shift register block, and an eth ($M+1 \leqq e \leqq M+N$; e is an integer) clock mask control circuit may generate an eth clock mask control signal based on a data enable signal output from an (e−1)th shift register block.

According to this display driver circuit, since the clock mask control signals can be generated by using a data enable signal which is sequentially shifted, a display driver circuit capable of reducing unnecessary power consumption can be realized with a simple circuit configuration.

In this display driver circuit, an fth ($1 \leqq f \leqq M+N$; f is a positive integer) shift register block may shift a data enable signal in the first direction and may hold an fth gray-scale data based on the data enable signal shifted in the first direction, when a given shift signal is at a first level, the fth shift register block may shift a data enable signal in the second direction and may hold the fth gray-scale data based on the data enable signal shifted in the second direction, when the shift signal is at a second level, and an fth clock mask control circuit may generate an fth clock mask control signal according to the level of the shift signal.

According to this display driver circuit, a display driver circuit which is capable of controlling the shift direction so that an optimum interconnect length can be obtained according to the mounting state and capable of reducing unnecessary power consumption can be provided.

According to another embodiment of the present invention, there is provided display driver circuit which drives signal electrodes of a display device based on gray-scale data, comprising:

first to (M+N)th (M and N are positive integers) shift register blocks;

a clock input control circuit which controls input of a clock signal which is supplied to each of the first to (M+N)th shift register blocks and determines shift timing;

first to (M+N)th clock mask circuits which generate first to (M+N)th clock signals by performing mask control for the clock signal supplied to the first to (M+N)th shift register blocks and output the first to (M+N)th clock signals; and a signal electrode driver circuit which drives the signal electrodes by using drive voltages corresponding to first to (M+N)th gray-scale data, the first to (M+N)th gray-scale data being held in the first to (M+N)th shift register blocks, wherein the first to Mth shift register blocks are disposed in a region on a first direction side of the clock input control circuit, shift a given data enable signal input to the first shift register block based on the first to Mth clock signals and output the shifted data enable signal to a shift register block adjacent in a second direction opposite to the first direction, and hold the first to Mth gray-scale data based on the shifted data enable signal, wherein the (M+1)th to (M+N)th shift register blocks are disposed in a region on the second direction side of the clock input control circuit, shift a data enable signal input to the (M+1)th shift register block from the Mth shift register block based on the (M+1)th to (M+N)th clock signals and output the shifted data enable signal to a shift register block adjacent in the second direction, and hold the (M+1)th to (M+N)th gray-scale data based on the shifted data enable signal, wherein the first to Mth clock mask circuits are connected in the second direction in order from the first to Mth clock mask circuit and mask the first to Mth clock signals in order from the first to Mth clock mask circuit, and wherein the (M+1)th to (M+N)th clock mask circuits are connected in the second direction in order from the (M+1)th to (M+N)th clock mask circuit and unmask the (M+1)th to (M+N)th clock signals in order from the (M+1)th to (M+N) th clock mask circuit.

In this display driver circuit, the clock signal of which input is controlled by the clock input control circuit is supplied to each of the shift register blocks.

In this case, each of the first to Mth shift register blocks holds each of the first to Mth gray-scale data based on a data enable signal to be shifted in the second direction based on each of the supplied clock signals while allowing the first to Mth clock mask circuits connected in the second direction in the region on the first direction side of the clock input control circuit to mask the first to Mth clock signals in order from the first to Mth clock mask circuit. This prevents unnecessary driving of the clock signal for a shift register block which has fetched the gray-scale data. Specifically, since it suffices to supply the clock signal only at the timing necessary for supplying the gray-scale data, unnecessary power consumption can be significantly reduced.

The (M+1)th to (M+N)th shift register blocks hold the (M+1)th to (M+N)th gray-scale data based on a data enable signal to be shifted in the second direction based on the supplied clock signal by allowing the (M+1)th to (M+N)th clock mask circuits connected in the second direction in the region on the second direction side of the clock input control circuit to unmask the (M+1)th to (M+N)th clock signals in order from the (M+1)th to (M+N)th clock mask circuit. This makes it possible to sequentially drive the clock signal only for a shift register block which has not fetched the gray-scale data. Specifically, since it suffices to supply the clock signal only at the timing necessary for supplying the gray-scale data, unnecessary power consumption can be significantly reduced.

According to a further embodiment of the present invention, there is provided a display driver circuit which drives signal electrodes of a display device based on gray-scale data, comprising:

first to Mth (M is a positive integer) shift register blocks;

a data input control circuit which controls input of the gray-scale data supplied to the first to Mth shift register blocks;

first to Mth data mask circuits which generate first to Mth gray-scale data by performing mask control for the gray-scale data supplied to the first to Mth shift register blocks and output the first to Mth gray-scale data, first to Mth gray-scale data being held in the first to Mth shift register blocks; and a signal electrode driver circuit which drives the signal electrodes by using drive voltages corresponding to the first to Mth gray-scale data, wherein the first to Mth shift register blocks are disposed in a region on a first direction side of the data input control circuit, shift a given data enable signal input to the first shift register block and output the shifted data enable signal to a shift register block adjacent in a second direction opposite to the first direction, and hold the first to Mth gray-scale data, for which mask control is performed by the first to Mth data mask circuits, based on the shifted data enable signal, and wherein the first to Mth data mask circuits are connected in the second direction in order from the first to Mth data mask circuit and mask the first to Mth gray-scale data in order from the first to Mth data mask circuit.

In this display driver circuit, the first to Mth shift register blocks hold the first to Mth gray-scale data based on a data enable signal to be shifted in the second direction while allowing each of the first to Mth data mask circuits connected in the second direction in the region on the first direction side of the data input control circuit to mask the first to Mth gray-scale data in order from the first to Mth data mask circuit. This prevents unnecessary driving of the gray-scale data input to a shift register block which has fetched the gray-scale data. Specifically, since it suffices to drive a bus to which the gray-scale data is supplied only at the timing necessary for supplying the gray-scale data, unnecessary power consumption can be significantly reduced.

According to still another embodiment of the present invention, there is provided a display driver circuit which drives signal electrodes of a display device based on gray-scale data, comprising:

first to Nth (N is a positive integer) shift register blocks;

a data input control circuit which controls input of the gray-scale data supplied to the first to Nth shift register blocks;

first to Nth data mask circuits which generate first to Nth gray-scale data by performing mask control for the gray-scale data supplied to the first to Nth shift register blocks and output the first to Nth gray-scale data, the first to Nth gray-scale data being held in the first to Nth shift register blocks; and a signal electrode driver circuit which drives the signal electrodes by using drive voltages corresponding to the first to Nth gray-scale data, wherein the first to Nth shift register blocks are disposed in a region on a second direction side of the data input control circuit, shift a given data enable signal input to the first shift register block and output the shifted data enable signal to a shift register block adjacent in the second direction, and hold the first to Nth gray-scale data, for which mask control is performed by the first to Nth data mask circuits, based on the shifted data enable signal, and wherein the first to Nth data mask circuits are connected in the second direction in order from the first to Nth data mask circuit and unmask the first to Nth gray-scale data in order from the first to Nth data mask circuit.

In this display driver circuit, the first to Nth shift register blocks hold the first to Nth gray-scale data based on a data enable signal to be shifted in the second direction by allowing the first to Nth data mask circuits connected in the second direction in the region on the second direction side of the data input control circuit to unmask the first to Nth gray-scale data in order from the first to Nth data mask circuit. This makes it possible to sequentially drive the gray-scale data only for a shift register block which has not fetched the gray-scale data. Specifically, since it suffices to drive a bus to which the gray-scale data is supplied only at the timing necessary for supplying the gray-scale data, unnecessary power consumption can be significantly reduced.

According to a still further embodiment of the present invention, there is provided a display driver circuit which drives signal electrodes of a display device based on gray-scale data, comprising:

first to Mth (M is a positive integer) shift register blocks;

a clock input control circuit which controls input of a clock signal which is supplied to each of the first to Mth shift register blocks and determines shift timing;

first to Mth clock mask circuits which generate first to Mth clock signals by performing mask control for the clock signal supplied to the first to Mth shift register blocks and output the first to Mth clock signals; and a signal electrode driver circuit which drives the signal electrodes by using drive voltages corresponding to first to Mth gray-scale data, wherein the first to Mth shift register blocks are disposed in a region on a first direction side of the clock input control circuit, shift a given data enable signal input to the first shift register block based on the first to Mth clock signals and output the shifted data enable signal to a shift register block adjacent in a second direction opposite to the first direction, and hold the first to Mth gray-scale data based on the shifted data enable signal, and wherein the first to Mth clock mask circuits are connected in the second direction in order from the first to Mth clock mask circuit and mask the first to Mth clock signals in order from the first to Mth clock mask circuit.

In this display driver circuit, the first to Mth shift register blocks hold the first to Mth gray-scale data based on a data enable signal shifted in the second direction based on the supplied clock signal while allowing the first to Mth clock mask circuits connected in the second direction in the region on the first direction side of the clock input control circuit to mask the first to Mth clock signals in order from the first to Mth clock mask circuit. This prevents unnecessary driving of the clock signal for a shift register block which has fetched the gray-scale data. Therefore, since it suffices to supply the clock signal corresponding to the timing necessary for supplying the gray-scale data, unnecessary power consumption can be significantly reduced.

According to yet another embodiment of the present invention, there is provided a display driver circuit which drives signal electrodes of a display device based on gray-scale data, comprising:

first to Nth (N is a positive integer) shift register blocks;

a clock input control circuit which controls input of a clock signal which is supplied to each of the first to Nth shift register blocks and determines shift timing;

first to Nth clock mask circuits which generate first to Nth clock signals by performing mask control for the clock signal supplied to the first to Nth shift register blocks and output the first to Nth clock signals; and a signal electrode driver circuit which drives the signal electrodes by using drive voltages corresponding to first to Nth gray-scale data, wherein the first to Nth shift register blocks are disposed in a region on a second direction side of the clock input control circuit, shift a given data enable signal input to the first shift register block based on the first to Nth clock signals and output the shifted data enable signal to a shift register block adjacent in the second direction, and hold the first to Nth gray-scale data based on the shifted data enable signal, and wherein the first to Nth clock mask circuits are connected in the second direction in order from the first to Nth clock mask circuit and unmask the first to Nth clock signals in order from the first to Nth clock mask circuit.

In this display driver circuit, the first to Nth shift register blocks hold the first to Nth gray-scale data based on a data enable signal to be shifted in the second direction based on the supplied clock signal by allowing the first to Nth clock mask circuits connected in the second direction in the region on the second direction side of the clock input control circuit to unmask the first to Nth clock signals in order from the first to Nth clock mask circuit. This makes it possible to sequentially drive the clock signal only for a shift register block which has not fetched the gray-scale data. Specifically, since it suffices to supply the clock signal corresponding to the timing necessary for supplying the gray-scale data, unnecessary power consumption can be significantly reduced.

According to a yet further embodiment of the present invention, there is provided a display device comprising pixels specified by a plurality of scan electrodes and a plurality of signal electrodes which intersect each other, a scan electrode driver circuit which drives the scan electrodes, and one of the above display driver circuits which drives the signal electrodes based on the gray-scale data.

According to a yet further embodiment of the present invention, there is provided a display device comprising a display panel including pixels specified by a plurality of scan electrodes and a plurality of signal electrodes which intersect each other, a scan electrode driver circuit which drives the scan electrodes, and one of the above display driver circuits which drives the signal electrodes based on the gray-scale data.

According to this configuration, a display device capable of significantly reducing power consumption can be provided.

What is claimed is:

1. A display driver circuit which drives signal electrodes of a display device based on gray-scale data, comprising:

first to (M+N)th (M and N are positive integers) shift register blocks;

a data input control circuit which controls input of the gray-scale data supplied to the first to (M+N)th shift register blocks;

first to (M+N)th data mask circuits which generate first to (M+N)th gray-scale data by performing mask control for the gray-scale data supplied to the first to (M+N)th shift register blocks and output the first to (M+N)th gray-scale data;

first to (M+N)th data mask control circuits which generate first to (M+N)th data mask control signals for performing mask control for the first to (M+N)th gray-scale data; and a signal electrode driver circuit which drives the signal electrodes by using drive voltages corresponding to the first to (M+N)th gray-scale data, the first to (M+N)th gray-scale data being held in the first to (M+N)th shift register blocks, wherein the first to Mth shift register blocks are disposed in a region on a first direction side of the data input control circuit, shift a given data enable signal input to the first shift register block and output the shifted data enable signal to a shift register block adjacent in a second direction opposite to the first direction, and hold the first to Mth gray-scale data based on the shifted data enable signal, wherein the (M+1)th to (M+N)th shift register blocks are disposed in a region on the second direction side of the data input control circuit, shift a data enable signal input to the (M+1)th shift register block from the Mth shift register block and output the shifted data enable signal to a shift register block adjacent in the second direction, and hold the (M+1)th to (M+N)th gray-scale data based on the shifted data enable signal, wherein the first to Mth data mask circuits are connected in the second direction in order from the first to Mth data mask circuit and mask the first to Mth gray-scale data in order from the first to Mth data mask circuit, wherein the (M+1)th to (M+N)th data mask circuits are connected in the second direction in order from the (M+1)th to (M+N)th data mask circuit and unmask the (M+1)th to (M+N)th gray-scale data in order from the (M+1)th to (M+N)th data mask circuit, wherein an ath ($1 \leqq a \leqq M$; a is an integer) data mask control circuit generates an ath data mask control signal based on a data enable signal output from an ath shift register block and an ath data mask circuit masks an ath gray-scale data based on the ath data mask control signal, and wherein a bth ($M+1 \leqq b \leqq M+N$; b is an integer) data mask control circuit generates a bth data mask control signal based on a data enable signal output from a (b-1)th shift register block and a bth data mask circuit masks a bth gray-scale data based on the bth data mask control signal.

2. The display driver circuit as defined in claim 1, wherein a cth ($1 \leqq c \leqq M+N$; c is an integer) shift register block shifts a data enable signal in the first direction and holds a cth gray-scale data based on the data enable signal shifted in the first direction, when a given shift signal is at a first level, wherein the cth shift register block shifts a data enable signal in the second direction and holds the cth gray-scale data based on the data enable signal shifted in the second direction, when the shift signal is at a second level, and wherein a cth data mask control circuit generates a cth data mask control signal according to the level of the shift signal.

3. The display driver circuit as defined in claim 1, further comprising:

a clock input control circuit which controls input of a clock signal which is supplied to each of the first to (M+N)th shift register blocks and determines shift timing of a data enable signal; and first to (M+N)th clock mask circuits which generate first to (M+N)th clock signals by performing mask control for the clock signal supplied to the first to (M+N)th shift register blocks and output the first to (M+N)th clock signals, wherein the first to Mth shift register blocks are disposed in the region on the first direction side of the clock input control circuit and shift a data enable signal based on the first to Mth clock signals, wherein the (M+1)th to (M+N)th shift register blocks are disposed in the region on the second direction side of the clock input control circuit and shift a data enable signal based on the (M+1)th to (M+N)th clock signals, wherein the first to Mth clock mask circuits are connected in the second direction in order from the first to Mth clock mask circuit and mask the first to Mth clock signals in order from the first to Mth clock mask circuit, and wherein the (M+1)th to (M+N)th clock mask circuits are connected in the second direction in order from the (M+1)th to (M+N)th clock mask circuit and unmask the (M+1)th to (M+N)th clock signals in order from the (M+1)th to (M+N)th clock mask circuit.

4. The display driver circuit as defined in claim 3, further comprising:

first to (M+N)th clock mask control circuits which generate first to (M+N)th clock mask control signals for performing mask control for the first to (M+N)th clock signals, wherein a dth ($1 \leqq d \leqq M$; d is an integer) clock mask control circuit generates a dth clock mask control signal based on a data enable signal output from a dth shift register block, and wherein an eth ($M+1 \leqq e \leqq M+N$; e is an integer) clock mask control circuit generates an eth clock mask control signal based on a data enable signal output from an (e-1)th shift register block.

5. The display driver circuit as defined in claim 4, wherein an fth ($1 \leqq f \leqq M+N$; f is a positive integer) shift register block shifts a data enable signal in the first direction and holds an fth gray-scale data based on the data enable signal shifted in the first direction, when a given shift signal is at a first level, wherein the fth shift register block shifts a data enable signal in the second direction and holds the fth gray-scale data based on the data enable signal shifted in the second direction, when the shift signal is at a second level, and wherein an fth clock mask control circuit generates an fth clock mask control signal according to the level of the shift signal.

6. A display driver circuit which drives signal electrodes of a display device based on gray-scale data, comprising:

first to Nth (N is a positive integer) shift register blocks;

a data input control circuit which controls input of the gray-scale data supplied to the first to Nth shift register blocks;

first to Nth data mask circuits which generate first to Nth gray-scale data by performing mask control for the gray-scale data supplied to the first to Nth shift register blocks and output the first to Nth gray-scale data, the first to Nth gray-scale data being held in the first to Nth shift register blocks;

first to Nth data mask control circuits which generate first to Nth data mask control signals for performing mask control for the first to Nth gray-scale data; and a signal electrode driver circuit which drives the signal electrodes by using drive voltages corresponding to the first to Nth gray-scale data, wherein the first to Nth shift register blocks are disposed in a region on a second direction side of the data input control circuit, shift a given data enable signal input to the first shift register block and output the shifted data enable signal to a shift register block adjacent in the second direction, and hold the first to Nth gray-scale data, for which mask control is performed by the first to Nth data mask circuits, based on the shifted data enable signal, wherein the first to Nth data mask circuits are connected in the second direction in order from the first to Nth data mask circuit and unmask the first to Nth gray-scale data in order from the first to Nth data mask circuit, and wherein an ath ($1 \leqq a \leqq N$; a is an integer) data mask control circuit generates an ath data mask control signal based on a data enable signal output from an ath shift register block and an ath data mask circuit masks an ath gray-scale data based on the ath data mask control signal.

7. A display device comprising:

pixels specified by a plurality of scan electrodes and a plurality of signal electrodes which intersect each other;

a scan electrode driver circuit which drives the scan electrodes; and the display driver circuit as defined in claim 1 which drives the signal electrodes based on the gray-scale data.

8. A display device comprising:

pixels specified by a plurality of scan electrodes and a plurality of signal electrodes which intersect each other;

a scan electrode driver circuit which drives the scan electrodes; and the display driver circuit as defined in claim 6 which drives the signal electrodes based on the gray-scale data.

9. A display device comprising:

a display panel including pixels specified by a plurality of scan electrodes and a plurality of signal electrodes which intersect each other;

a scan electrode driver circuit which drives the scan electrodes; and the display driver circuit as defined in claim 1 which drives the signal electrodes based on the gray-scale data.

10. A display device comprising:

a display panel including pixels specified by a plurality of scan electrodes and a plurality of signal electrodes which intersect each other;

a scan electrode driver circuit which drives the scan electrodes; and the display driver circuit as defined in claim 6 which drives the signal electrodes based on the gray-scale data.

* * * * *